US010995562B2

(12) United States Patent
Wagoner et al.

(10) Patent No.: US 10,995,562 B2
(45) Date of Patent: May 4, 2021

(54) ROTATING CONTROL DEVICE, AND INSTALLATION AND RETRIEVAL THEREOF

(71) Applicant: WEATHERFORD TECHNOLOGY HOLDINGS, LLC, Houston, TX (US)

(72) Inventors: Danny W. Wagoner, Waller, TX (US); Tuong T. Le, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 96 days.

(21) Appl. No.: 15/850,186

(22) Filed: Dec. 21, 2017

(65) Prior Publication Data

US 2018/0155993 A1 Jun. 7, 2018

Related U.S. Application Data

(62) Division of application No. 15/153,356, filed on May 12, 2016, now Pat. No. 10,408,000.

(51) Int. Cl.

| | |
|---|---|
| ***E21B 19/00*** | (2006.01) |
| ***E21B 17/01*** | (2006.01) |
| ***E21B 33/08*** | (2006.01) |

(52) U.S. Cl.

CPC ..... *E21B 19/002* (2013.01); *E21B 17/01* (2013.01); *E21B 33/085* (2013.01)

(58) Field of Classification Search

CPC ..... E21B 33/085; E21B 19/002; E21B 17/01

See application file for complete search history.

(56) References Cited

U.S. PATENT DOCUMENTS

| | | | |
|---|---|---|---|
| 2,266,968 | A | 12/1941 | Hamilton |
| 2,921,633 | A | 1/1960 | Baker |
| 3,207,221 | A | 9/1965 | Cochran et al. |
| 3,603,385 | A | 9/1971 | Jones |
| 3,991,826 | A | 11/1976 | Baugh |
| 4,590,995 | A | 5/1986 | Evans |

(Continued)

FOREIGN PATENT DOCUMENTS

| | | | |
|---|---|---|---|
| EP | 2216498 | A2 | 8/2010 |
| WO | 2016053294 | A1 | 4/2016 |

OTHER PUBLICATIONS

Canadian Office Action dated Sep. 24, 2018 for CA Patent application No. 2,965,614.

(Continued)

*Primary Examiner* — Aaron L Lembo

(74) *Attorney, Agent, or Firm* — Smith IP Services, P.C.

(57) ABSTRACT

A rotating control device can include a latch assembly with a lock ring that permits displacement of an inner mandrel in one longitudinal direction, and prevents displacement of the inner mandrel in an opposite longitudinal direction. Another rotating control device can include a latch assembly and an equalization valve having an open configuration in which fluid communication is permitted between an exterior and an interior of the rotating control device through the equalization valve, the latch assembly changing from a latched to an unlatched configuration only when the equalization valve is in the open configuration. A method of installing a rotating control device can include releasing a running tool from the rotating control device by producing relative rotation between components of the running tool.

7 Claims, 32 Drawing Sheets

(56) References Cited

U.S. PATENT DOCUMENTS

| | | | | |
|---|---|---|---|---|
| 4,591,197 | A | 5/1986 | Akkerman | |
| 4,836,278 | A | 6/1989 | Stone et al. | |
| 4,842,082 | A | 6/1989 | Springer | |
| 7,159,669 | B2 | 1/2007 | Bourgoyne et al. | |
| 7,487,837 | B2 | 2/2009 | Bailey et al. | |
| 7,699,109 | B2 * | 4/2010 | May | E21B 33/085 166/367 |
| 7,836,946 | B2 | 11/2010 | Bailey et al. | |
| 7,926,593 | B2 | 4/2011 | Bailey et al. | |
| 7,997,345 | B2 | 4/2011 | Hannegan | |
| 8,136,588 | B2 | 3/2012 | Mason | |
| 8,322,432 | B2 | 12/2012 | Bailey et al. | |
| 9,051,790 | B2 | 6/2015 | Orbell et al. | |
| 9,353,587 | B2 | 5/2016 | Bansal et al. | |
| 9,611,708 | B2 | 4/2017 | Rios, III | |
| 10,006,270 | B2 | 6/2018 | Schwendemann et al. | |
| 10,287,838 | B2 * | 5/2019 | Van Bilderbeek | E21B 33/04 |
| 2003/0106712 | A1 * | 6/2003 | Bourgoyne | E21B 21/001 175/5 |
| 2005/0023866 | A1 * | 2/2005 | Matusek | E21B 23/04 296/210 |
| 2005/0236158 | A1 | 10/2005 | Miyahara | |
| 2009/0161997 | A1 | 6/2009 | Beauchamp et al. | |
| 2010/0175882 | A1 * | 7/2010 | Bailey | E21B 33/085 166/335 |
| 2010/0243235 | A1 | 9/2010 | Caldwell et al. | |
| 2011/0036638 | A1 | 2/2011 | Sokol et al. | |
| 2012/0013133 | A1 | 1/2012 | Rios, III et al. | |
| 2012/0055677 | A1 | 3/2012 | Boyd | |
| 2012/0085545 | A1 * | 4/2012 | Tarique | E21B 33/085 166/360 |
| 2012/0292054 | A1 | 11/2012 | Drbell et al. | |
| 2012/0318496 | A1 | 12/2012 | Bailey et al. | |
| 2013/0133891 | A1 | 5/2013 | Getzlaf et al. | |
| 2013/0153242 | A1 | 6/2013 | Flight et al. | |
| 2014/0014353 | A1 | 1/2014 | Rios, III | |
| 2014/0069720 | A1 | 3/2014 | Gray | |
| 2015/0226024 | A1 | 8/2015 | Travis et al. | |
| 2016/0123399 | A1 | 5/2016 | Arnt et al. | |
| 2016/0245028 | A1 | 8/2016 | Arnt | |
| 2016/0245037 | A1 | 8/2016 | Gray et al. | |
| 2016/0305213 | A1 | 10/2016 | Godfrey et al. | |
| 2017/0114602 | A1 | 4/2017 | Grace | |

OTHER PUBLICATIONS

International Search Report with Written Opinion dated Dec. 28, 2017 for PCT Patent Application No. PCT/US2017/048407, 16 pages.
Specification and drawings for U.S. Appl. No. 15/153,356, filed May 12, 2016, 72 pages.
Specification and drawings for U.S. Appl. No. 15/252,499, filed Aug. 31, 2016, 69 pages.
Specification and drawings for U.S. Appl. No. 15/783,871, filed Oct. 13, 2017, 40 pages.
Office Action dated Jun. 6, 2017 for U.S. Appl. No. 15/153,356, 12 pages.
Weatherford; "Bearing Assembly, Running Tool 6-5/8 FH, Running Tool 7800/7875", drawing No. D000414120, dated Jun. 2, 2008, 1 page.
Weatherford; "Assembly, Weldment SRD Joint AGR Chevron", drawing No. D000459938, dated Jul. 15, 2011, 1 page.
Office Action dated Jul. 10, 2018 for U.S. Appl. No. 15/153,356, 9 pages.
European Search Report dated Dec. 2, 2018 for EP Patent Application No. 17170899.3, 11 pages.
Office Action dated Nov. 28, 2018 for U.S. Appl. No. 15/153,356, 10 pages.
International Search Report with Written Opinion dated Jan. 10, 2019 for PCT Patent Application No. PCT/US2018/053470, 11 pages.
Advisory Action dated Apr. 4, 2019 for U.S. Appl. No. 15/153,356, 19 pages.
Office Action dated Feb. 5, 2019 for U.S. Appl. No. 15/153,356, 6 pages.
Office Action dated Jul. 31, 2019 for U.S. Appl. No. 15/783,871, 55 pages.
Office Action dated Aug. 20, 2019 for U.S. Appl. No. 16/199,375, 29 pages.
Office Action dated Jan. 7, 2020 for U.S. Appl. No. 15/783,871, 11 pages.
Office Action dated Jan. 7, 2020 for U.S. Appl. No. 16/199,375, 10 pages.
Office Action dated May 18, 2020 for U.S. Appl. No. 15/783,871, 7 pages.
Singapore Search Report and Written Opinion dated Mar. 10, 2020 for SG Patent Application No. 10201703846Y, 87 pages.
Office Action dated Sep. 17, 2020 for U.S. Appl. No. 16/199,375, 12 pages.

* cited by examiner

ROTATING CONTROL DEVICE, AND INSTALLATION AND RETRIEVAL THEREOF

CROSS-REFERENCE TO RELATED APPLICATION

This application is a division of prior application Ser. No. 15/153,356 filed on May 12, 2016. The entire disclosure of this prior application is incorporated herein by this reference.

BACKGROUND

This disclosure relates generally to equipment utilized and operations performed in conjunction with a subterranean well and, in an example described below, more particularly provides a rotating control device, and tools for installation and retrieval of the rotating control device.

A rotating control device is typically used to seal off an annular space between an outer tubular structure (such as, a riser, a housing on a subsea structure in a riser-less system, or a housing attached to a surface wellhead) and an inner tubular (such as, a drill string). At times it may be desired for components (such as, bearings, seals, etc.) of the rotating control device to be retrieved from, or installed in, a riser housing.

Therefore, it will be appreciated that advancements are continually needed in the arts of constructing and operating rotating control devices. In particular, it would be desirable to provide for convenient and efficient installation and retrieval of rotating control device components respectively into and out of a riser housing.

DETAILED DESCRIPTION

Figure 1:
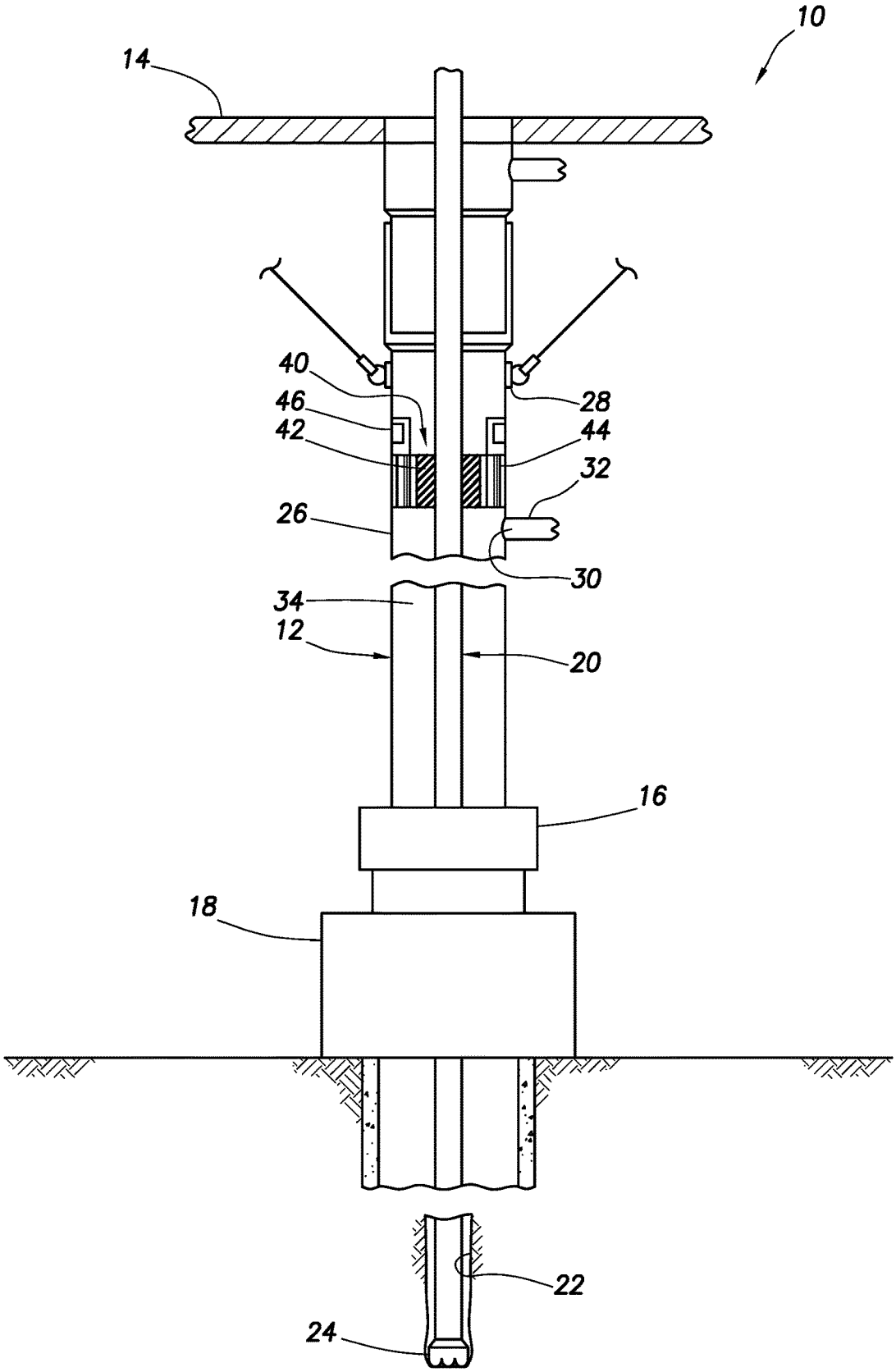
FIG. 1 is a representative partially cross-sectional view of an example of a well system and associated method which can embody principles of this disclosure.

Representatively illustrated in FIG. 1 is a well system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a lower end of the tubular string 20.

The drill bit 24 may be rotated by rotating the tubular string 20 (for example, using a top drive or rotary table of the rig 14), and/or a drilling motor may be connected in the tubular string above the drill bit 24.

Furthermore, the principles of this disclosure could be utilized in well operations other than drilling operations. Thus, it should be appreciated that the scope of this disclosure is not limited to any of the details of the tubular string 20 or wellbore 22 as depicted in the drawings or as described herein.

The riser string 12 depicted in FIG. 1 includes a riser housing 26 connected in the riser string below a tensioner ring 28. In other examples, the riser housing 26 could be connected above the tensioner ring 28, or could be otherwise positioned (such as, in the wellhead installation 18 in a riser-less configuration). Thus, the scope of this disclosure is not limited to any particular details of the riser string 12 or riser housing 26 as described herein or depicted in the drawings.

The riser housing 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig via the conduit 32.

As depicted in FIG. 1, a rotating control device 40 is installed in the riser housing 26. The rotating control device 40 includes one or more annular seals 42 that seal off the annulus 34 above the side port 30.

In this example, the annular seals 42 are configured to sealingly engage an exterior of the tubular string 20. The annular seals 42 may be of a type known to those skilled in the art as "passive," "active" or a combination of passive and active. The scope of this disclosure is not limited to use of any particular type of annular seal.

Rotation of the annular seals 42 relative to the riser housing 26 is provided for by a bearing assembly 44 of the rotating control device 40. The annular seals 42 and bearing assembly 44 are releasably secured in the riser housing 26 by a latch assembly 46 of the rotating control device. The latch assembly 46 permits the annular seals 42 and/or the bearing assembly 44 to be installed in, or retrieved from, the riser housing 26 when desired, for example, to service or replace the seals and/or bearing assembly.

The tubular string 20 can include running and retrieval tools, examples of which are described more fully below and depicted in FIGS. 2A-14D, for installing and retrieving the rotating control device 40. However, it should be clearly understood that the scope of this disclosure is not limited to these particular examples of running and retrieval tools, and is not limited to use of a running or retrieval tool as part of the tubular string 20 of FIG. 1.

Figure 2A:
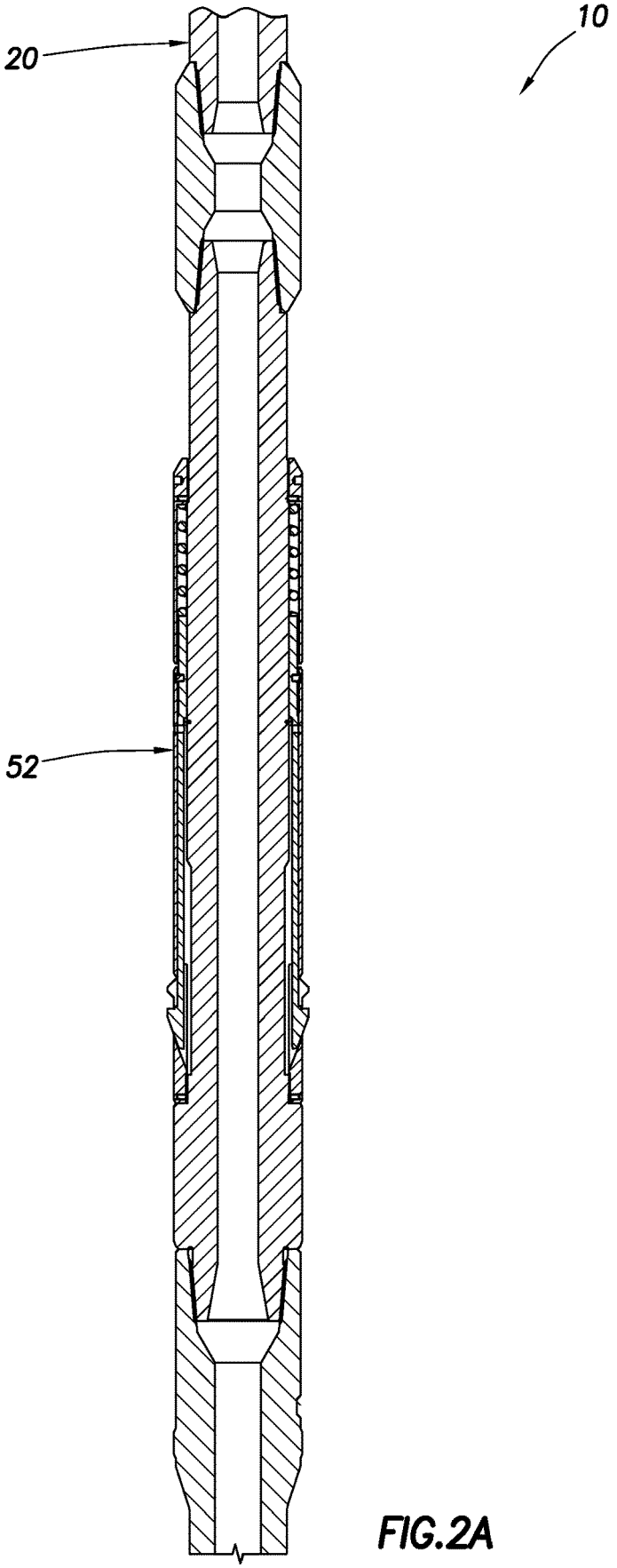
FIGS. 2A-E are representative successive axial sections of a portion of the well system depicting a rotating control device being conveyed into a riser housing by a running tool.
Figure 2B:
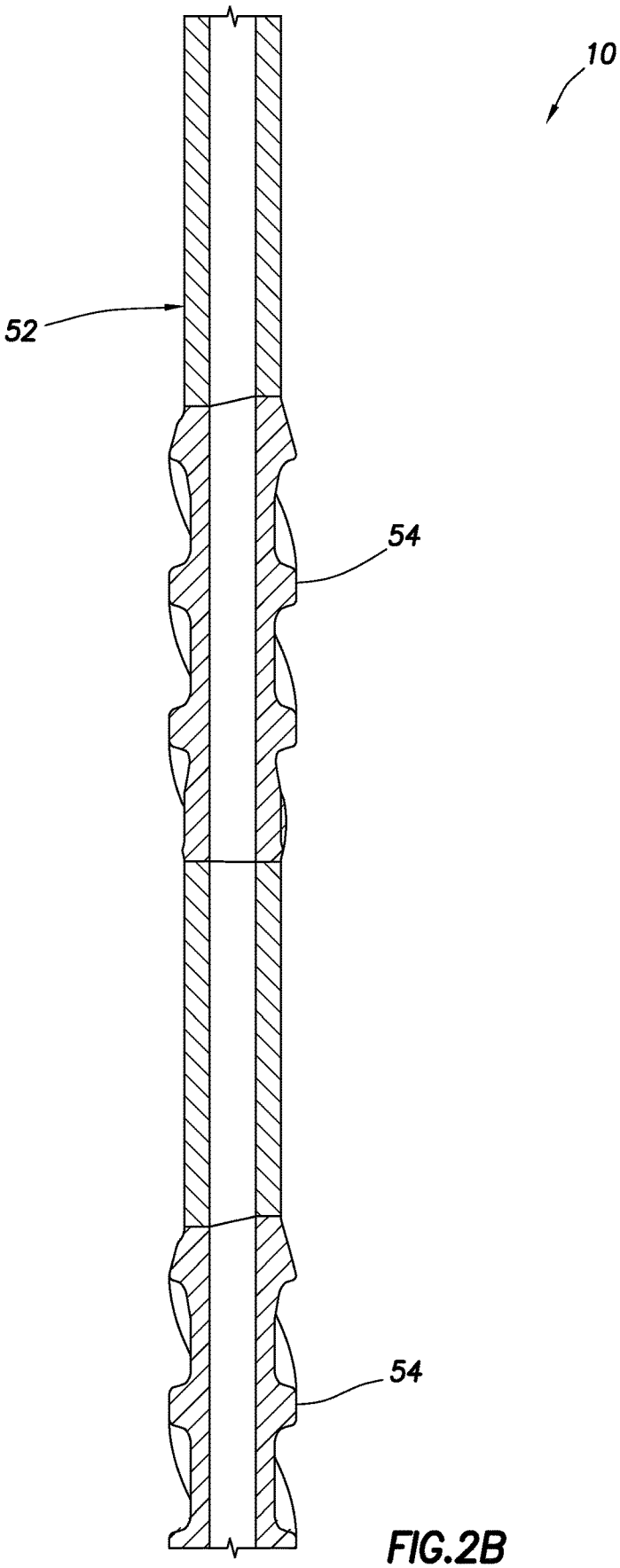
Figure 2C:
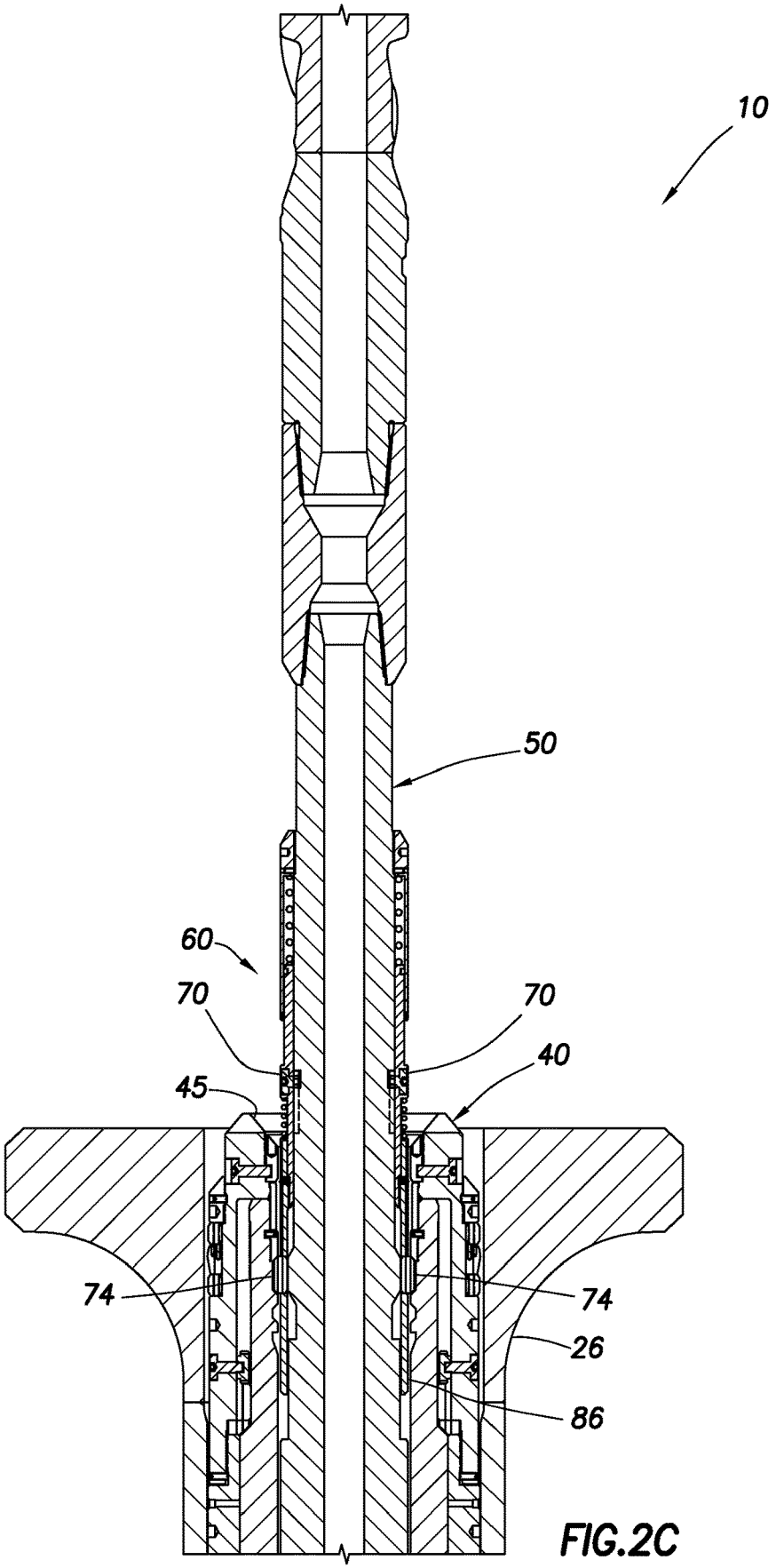

Referring now to FIG. 2C, prior to running the rotating control device 40 into the well, running tool 50 must be securely attached to latch assembly 46 of the rotating control device 40. Pins 70 are first removed from running tool 50. Running tool 50 is then lowered into latch assembly 46 of rotating control device 40. Releasing members 74 of running tool 50 are first contacted at upper shoulder 45 of latch assembly 46 of rotating control device 40. Inner mandrel 48 of running tool 50 compresses against a biasing device 78 (such as, a compression spring, an elastomeric member, a compressible fluid, etc.) as it is lowered into latch assembly 46 of the rotating control device 40. The shoulder of inner mandrel 48 that supports releasing members 74 outwardly is moved below releasing members 74 allowing them to collapse inwardly onto inner mandrel 48 of running tool 50. The biasing device 78 urges sleeve 86 (where release members 74 are contained) downwardly and seeks to push the release members 74 back onto the larger shoulder from which they were previously located. Once the proper profile within latch mandrel 62 of latch assembly 46 is located, the biasing device 78 causes release members 74 to move up the shoulder of inner mandrel 48 and engage the profile in latch mandrel 62 of latch assembly 46. Pins 70 can now be reinstalled into running tool 50, securely attaching it to the rotating control device 40.

The pins 70 are used to allow setting of the rotating control device 40 and also enable the release of the running tool 50 from the latch assembly 46 by a rotational release method. Further, pins 70 can be sheared in an emergency situation in the unlikely event of a malfunction in the setting procedure of the rotating control device 40. The various positions of the pins 70 to achieve these functions are depicted in FIGS. 11A-14D. Once these pins 70 have been secured, the rotating control device 40 cannot be set until the latch members 56 locate the setting profile 58 within the wellbore (see FIG. 2D). Further, the running tool 50 cannot be rotationally released from the rotating control device 40 until it is set, since it requires frictional resistance from the packer seal 47 of the latch assembly 46.

Referring additionally now to FIGS. 2A-E, an example of the rotating control device 40 being conveyed into the riser housing 26 by the running tool 50 is representatively illustrated. The running tool 50 is connected as part of the tubular string 20, which in this example also includes a retrieval tool 52 connected above the running tool. In other examples, the running tool 50 may be used without the retrieval tool 52, and vice versa.

The running tool 50 and retrieval tool 52 of the FIGS. 2A-E example include helically extending externally fluted sections 54 (see FIG. 2B) for preventing effective sealing engagement between the annular seals 42 and the tubular string 20 while the rotating control device 40 is being installed or retrieved. The fluted sections 54 provide for fluid communication longitudinally across the annular seals 42 to prevent swabbing (e.g., producing undesired pressure fluctuations in the wellbore 22), and to otherwise prevent buildup of differential pressure across the annular seals, thus slowing the tool string as it is being deployed or being retrieved from the well.

In other examples, differential pressure buildup across the annular seals 42 could be prevented by other means, such as by use of internal passages in the running and retrieval tools 50, 52, by use of internal passages in the rotating control device 40, etc. Thus, the scope of this disclosure is not limited to any particular details of the running and retrieval tools 50, 52 as depicted in the drawings or as described herein.

Figure 2D:
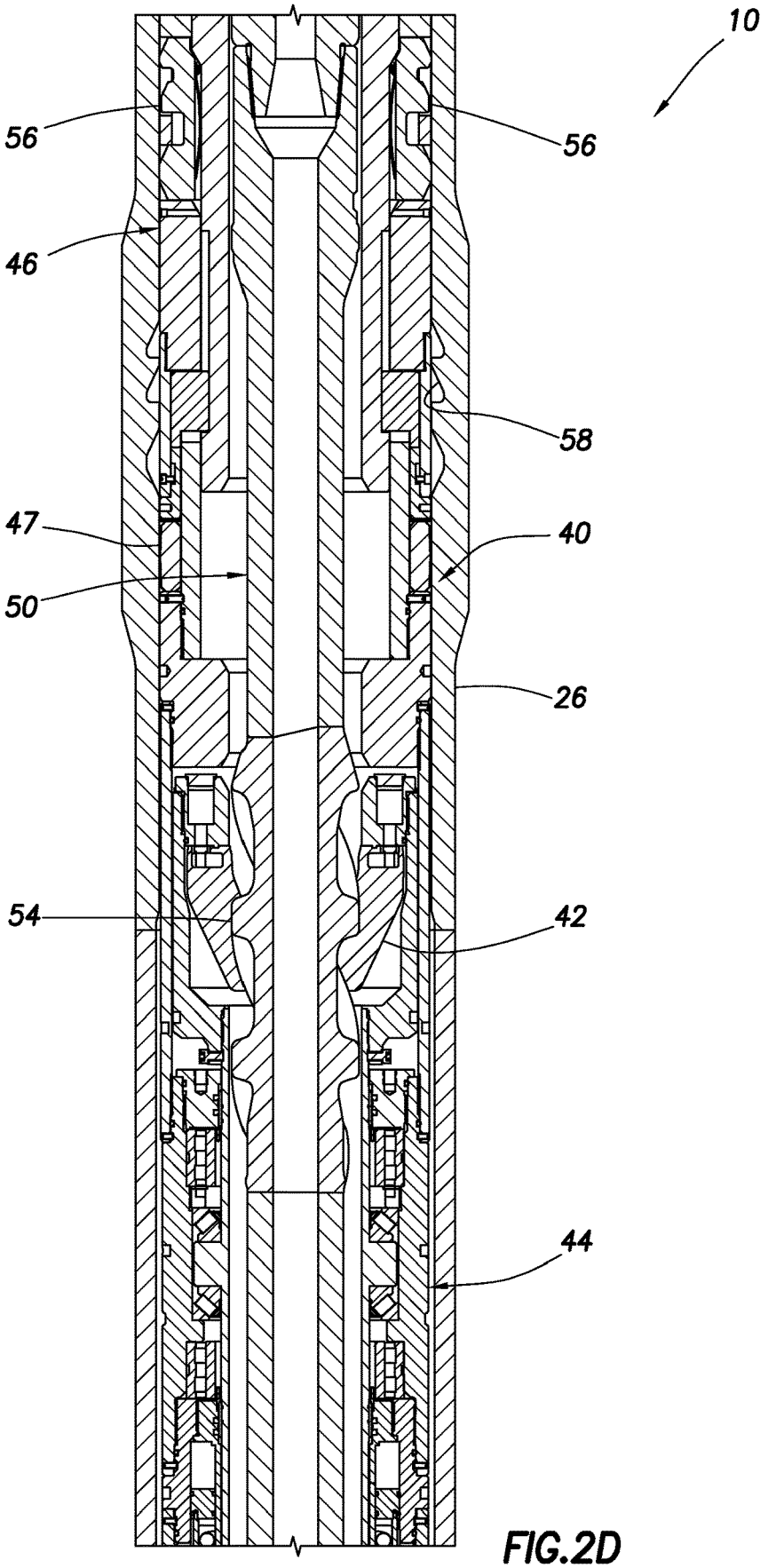

In FIG. 2D, it may be seen that the latch assembly 46 of the rotating control device 40 includes multiple latch members 56. The latch members 56 are radially outwardly biased, and are configured for complementary engagement with an internal profile 58 formed in the riser housing 26. As the rotating control device 40 is displaced downwardly through the riser housing 26, the latch members 56 will eventually become aligned with the internal profile 58, and will radially outwardly extend into engagement with the profile, thereby preventing further downward displacement of the rotating control device relative to the riser housing 26.

In FIG. 2C, it may be seen that the running tool 50 is releasably secured to the rotating control device 40 by a release mechanism 60. Operation of the release mechanism 60 to permit longitudinal displacement of the running tool 50 and the remainder of the tubular string 20 relative to the rotating control device 40 is described more fully below.

Figure 3A:
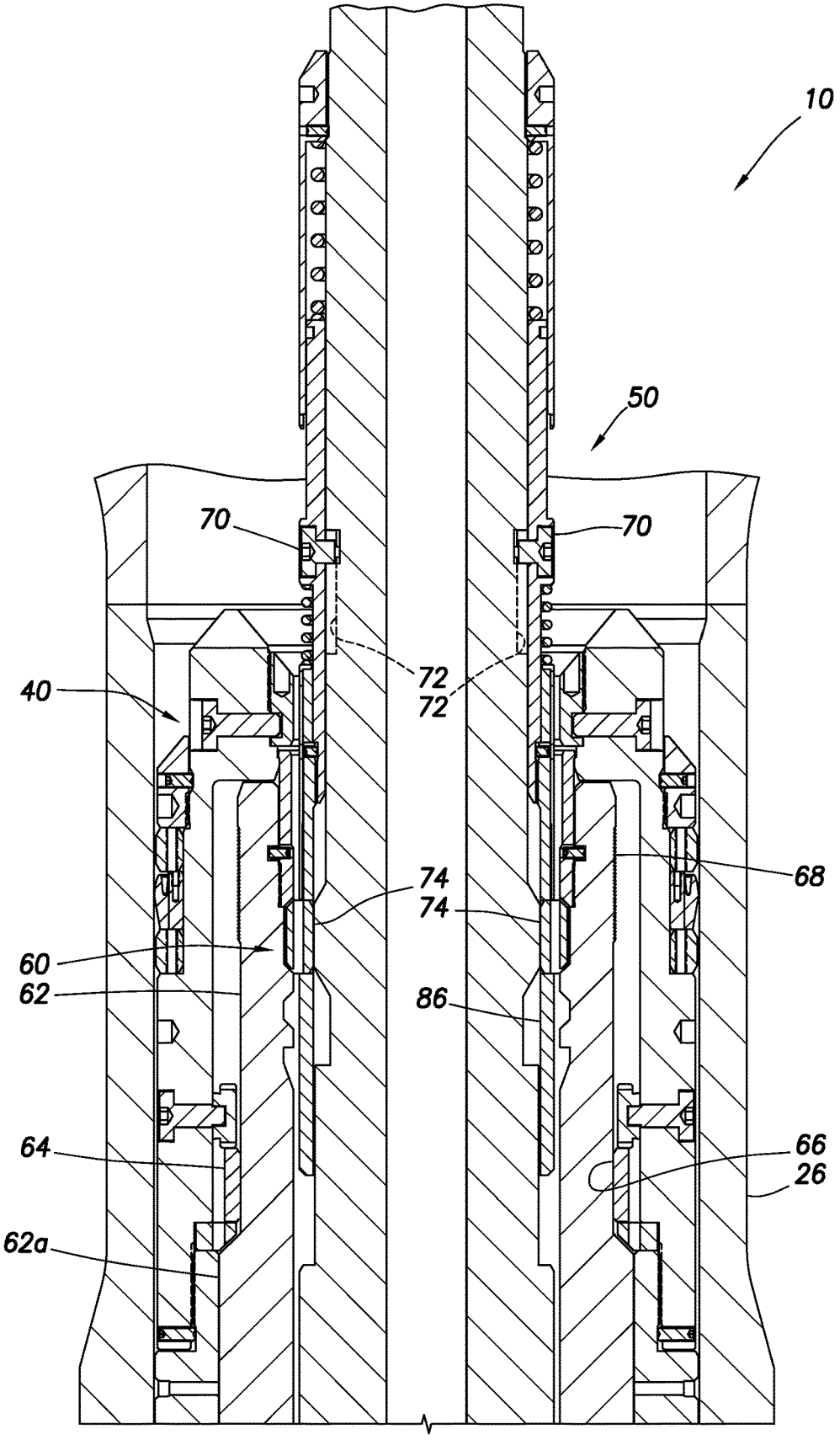
FIGS. 3A&B are further enlarged representative cross-sectional views of a latch assembly for the rotating control device operatively located in the riser housing.

Referring additionally now to FIGS. 3A&B, the rotating control device 40 has been conveyed sufficiently far into the riser housing 26 for the latch members 56 to cooperatively engage the internal profile 58. Thus, further downward displacement of the rotating control device 40 relative to the riser housing 26 is prevented.

Note that the latch assembly 46 includes an inner mandrel 62 having a radially enlarged portion **62*a*. The inner mandrel 62 is longitudinally displaceable relative to the latch members 56 only after the latch members have engaged the internal profile 58**.

Figure 4A:
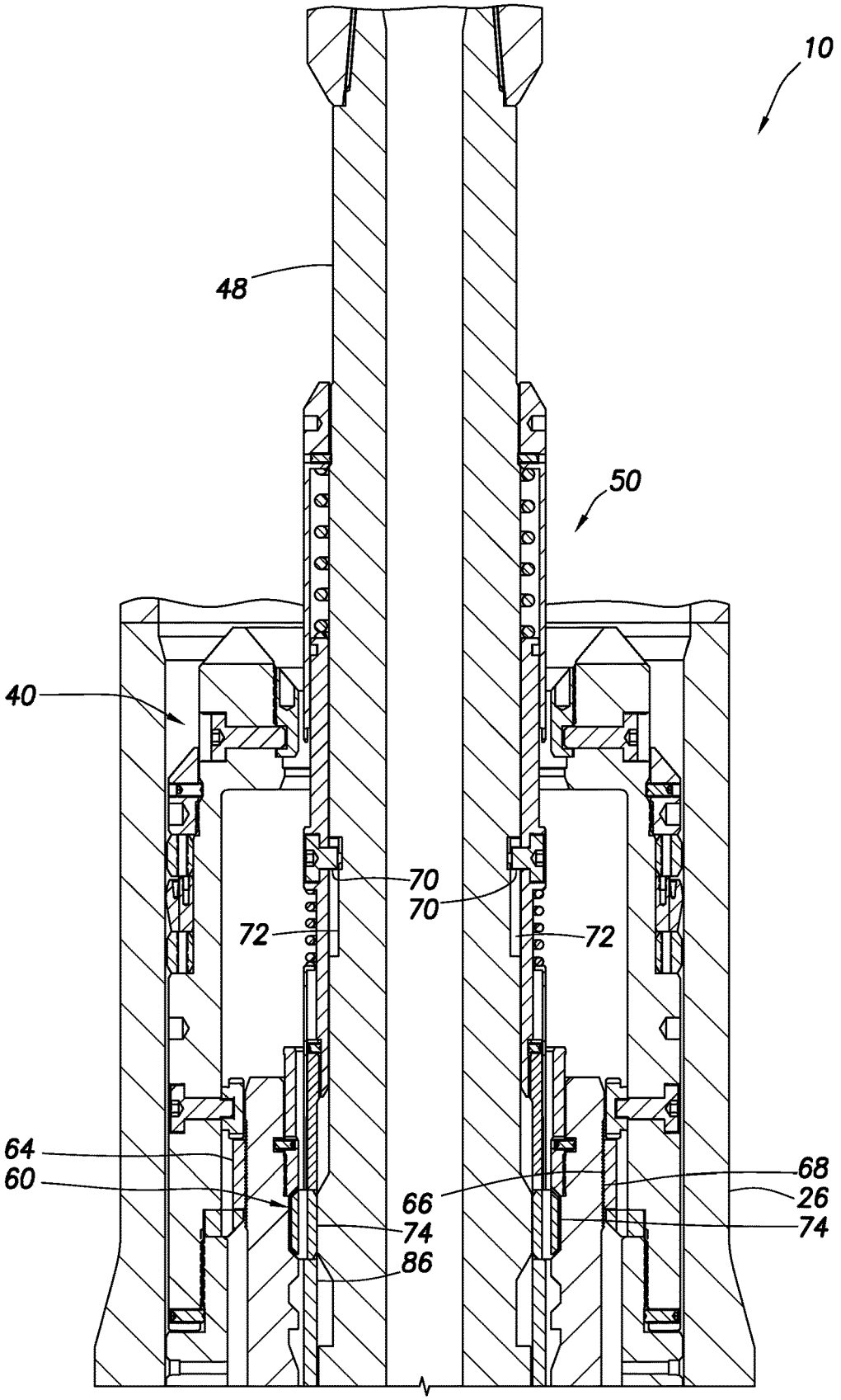
FIGS. 4A&B are representative cross-sectional views of the running tool rotated in preparation for release from the latch assembly of the rotating control device.
Figure 4B:
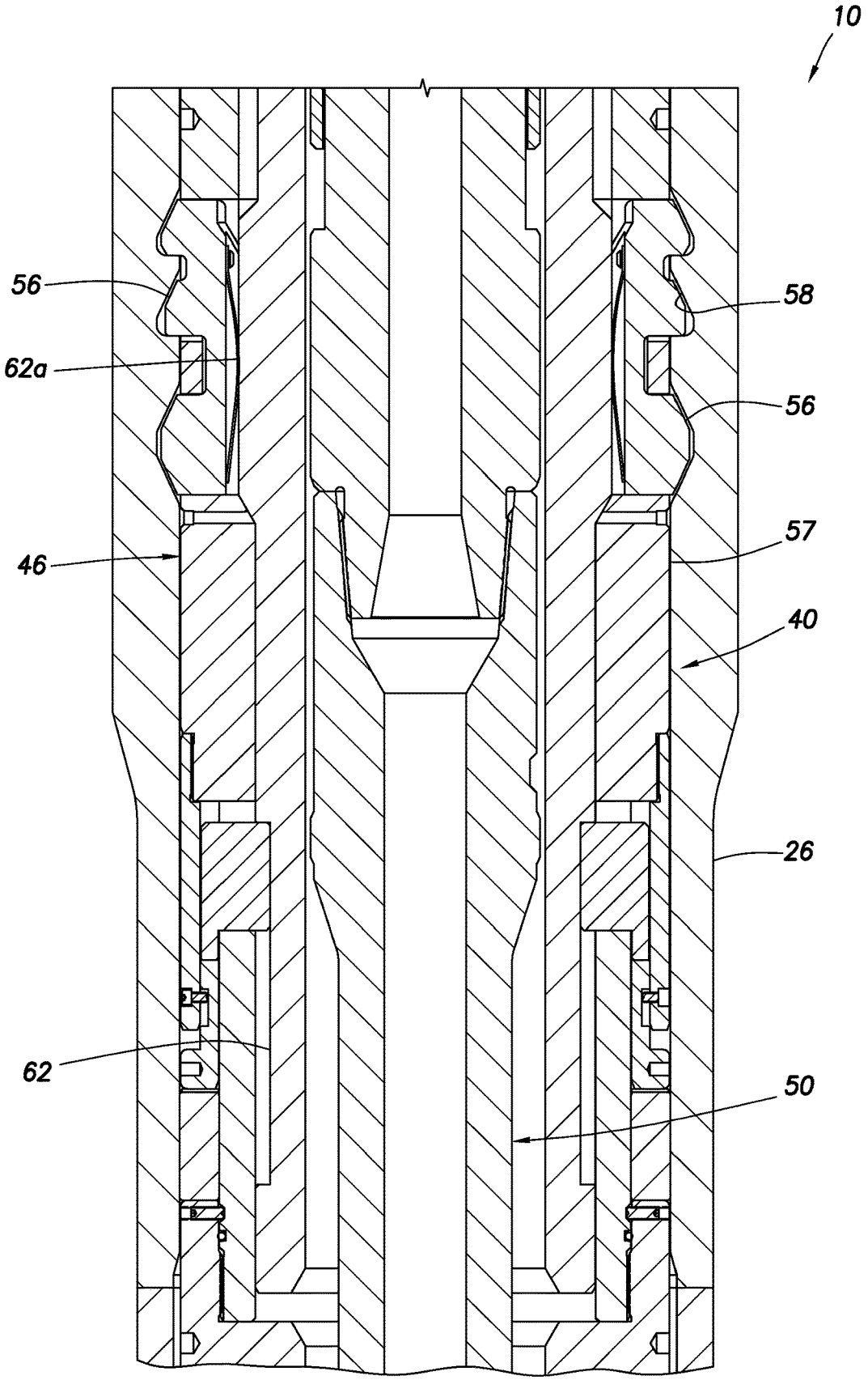

Refer now to FIGS. 4A&B. When the latch members 56 have engaged the internal profile 58, the running tool 50 is moved downwardly against the release members 74. The release collet disengages from the outer members of the latch assembly 46 at a preset force to allow displacement of the inner mandrel 62 longitudinally downward relative to the latch members 56. This positions the radially enlarged portion 62*a* of the inner mandrel 62 adjacent to the latch members 56, and prevents disengagement of the latch members 56 from the internal profile 58 in the riser housing 26.

This position of the inner mandrel 62 is maintained by a gripping engagement between the inner mandrel 62 and a lock ring 64 of the rotating control device 40. In this example, the lock ring 64 is a resilient C-shaped ring that is biased radially inward into gripping engagement with an outer gripping surface 68 of inner mandrel 62.

The lock ring 64 includes an internal gripping surface 66. For example, the gripping surface 66 can have appropriately configured teeth formed thereon, or can have relatively high hardness particles embedded therein or otherwise secured thereto.

The inner mandrel 62 also includes an external gripping surface 68. Similar to the lock ring gripping surface 66, the inner mandrel gripping surface 68 can have appropriately configured teeth formed thereon, or can otherwise be configured for gripping engagement with the lock ring 64.

In this example, the gripping surfaces 66, 68 are initially spaced apart from each other (e.g., see FIG. 3A). The gripping surfaces 66, 68 engage each other when the inner mandrel 62 displaces downward relative to the latch members 56. However, in other examples, the gripping surfaces 66, 68 may not be initially spaced apart from each other.

The gripping engagement between the lock ring 64 and the inner mandrel 62 prevents the inner mandrel from displacing upward relative to the latch members 56, in order to prevent subsequent disengagement of the latch members 56 from the internal profile 58. As described more fully below, however, the retrieval tool 52 (see FIG. 2A) can be used to displace the inner mandrel 62 upward when it is desired to retrieve the rotating control device 40 from the riser housing 26.

As depicted in FIGS. 4A&B, the inner mandrel 48 of the running tool 50 has been rotated relative to the rotating control device 40 (in this example, rotated clockwise as viewed from above). This causes alignment of pins 70 with longitudinally extending slots 72 of the release mechanism 60 in preparation to be disengaged from the rotating control device 40.

To rotate the inner mandrel 48 of the running tool 50, the packer seal 47 must be set to cause necessary resistance for desired rotation. Parts of the latch assembly 46 (the packer seal 47, the latch body 57, the inner mandrel 62) and parts of the running tool 50 (the release members 74, sleeve 86, pins 70) are connected in such a manner as to remain stationary during rotation. This alignment of the pins 70 with the slots 72 will permit subsequent upward displacement of the inner mandrel 48 against release members 74 of the release mechanism 60.

Figure 5A:
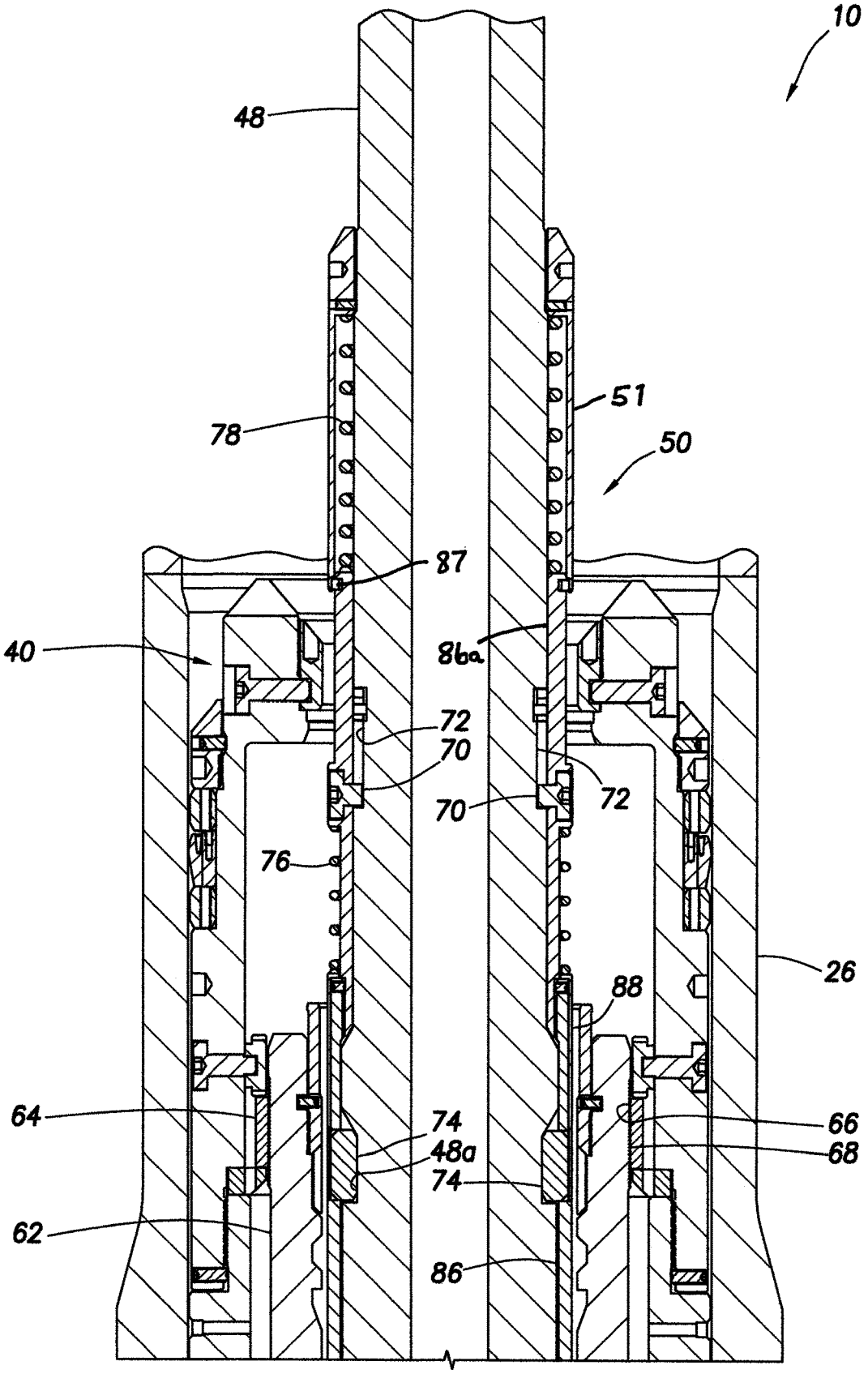
FIGS. 5A&B are representative cross-sectional views of the running tool released from the rotating control device.
Figure 5B:
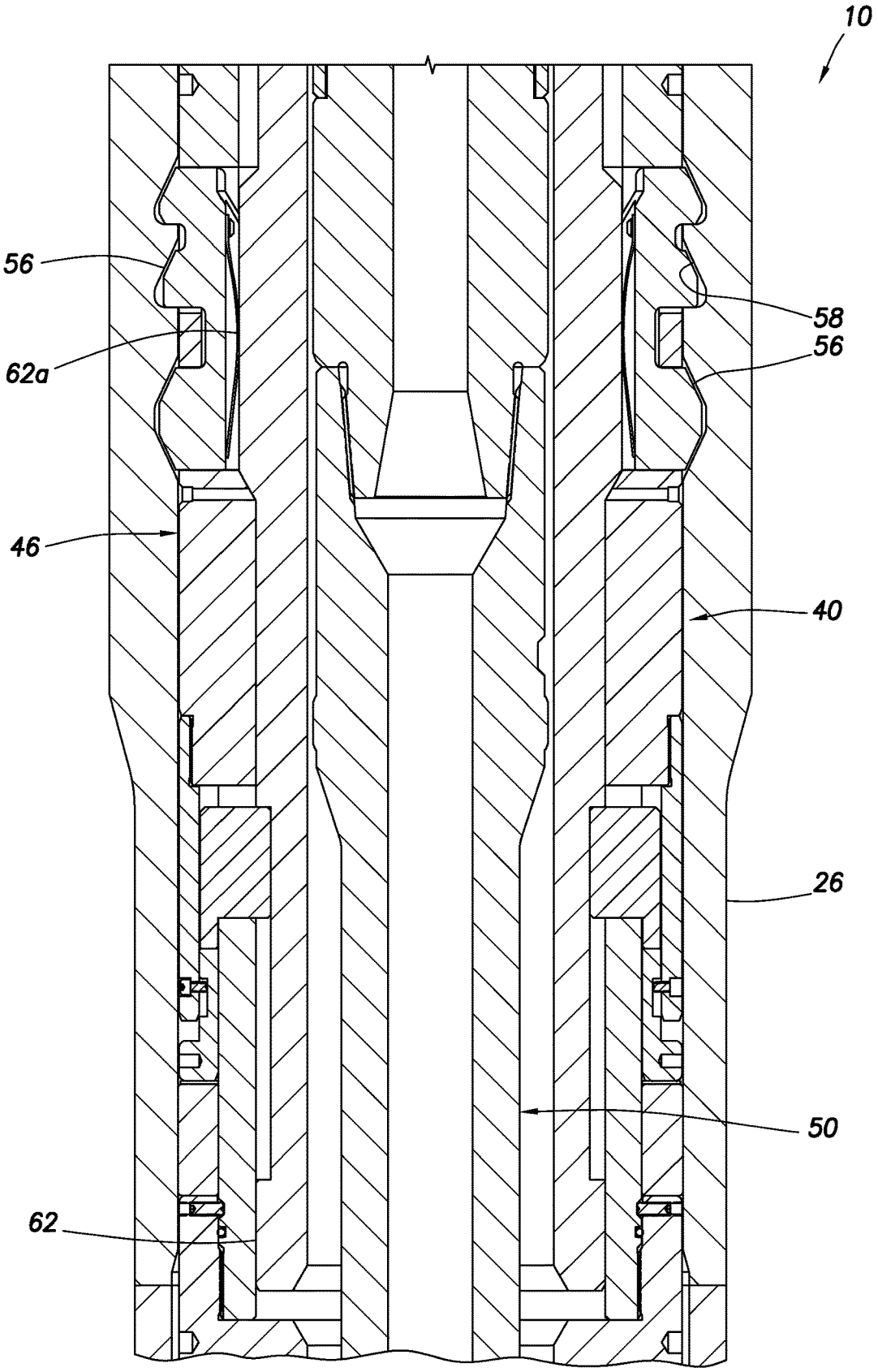

Referring additionally now to FIGS. 5A&B, the running tool 50 has been displaced upward relative to the rotating control device 40. This upward displacement of the running tool 50 forces the release members 74 to retract inwardly out of engagement with the rotating control device 40, so that the running tool 50 is now released from the rotating control device 40 and can be displaced substantially upwardly or downwardly relative to the rotating control device 40.

Note that the release members 74 are able to retract inwardly due to a radially reduced portion 48*a* of an inner mandrel 48 of the running tool 50 being positioned adjacent the release members when the inner mandrel 48 is displaced upwardly. Note, also, that such upward displacement of the inner mandrel 48 relative to the release members 74 is permitted, due to the alignment between the pins 70 and the longitudinal slots 72 of the release mechanism 60.

A biasing device 76 (such as, a compression spring, an elastomeric member, a compressible fluid, etc.) urges a relatively thin sleeve 88 downward and over the retracted release members 74 (to prevent subsequent outward displacement of the release members 74). A top portion 86*a* of sleeve 86 contains an outwardly biased device 87 (such as a snap ring, an elastomeric member, etc.) which expands outwardly into a recess of an outer housing 51 of the running tool 50. This also prevents the release mechanism 60 from becoming reengaged. Another biasing device 78 urges the pins 70 downward relative to the slots 72.

Figure 2E:
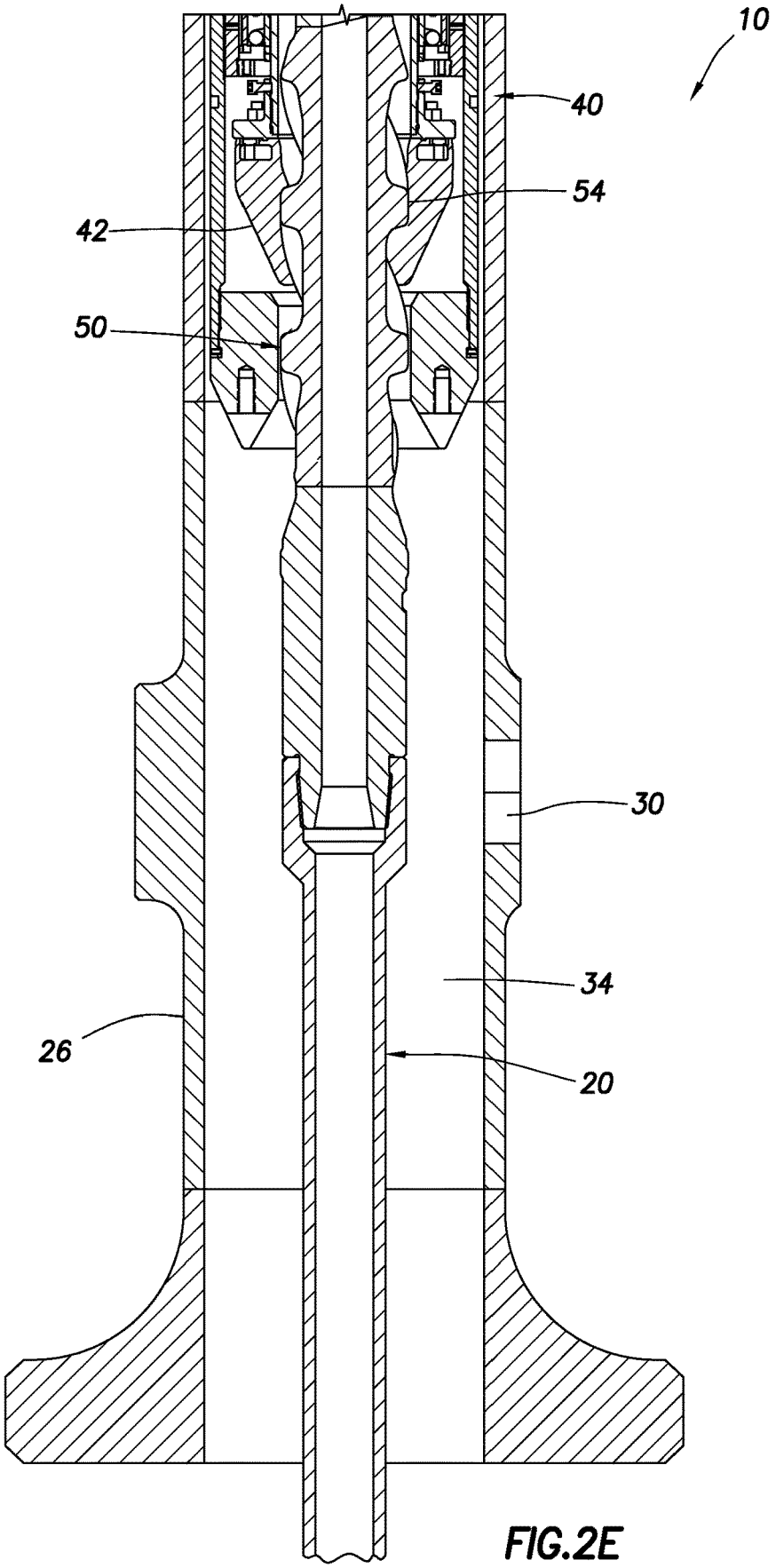
Figure 6A:
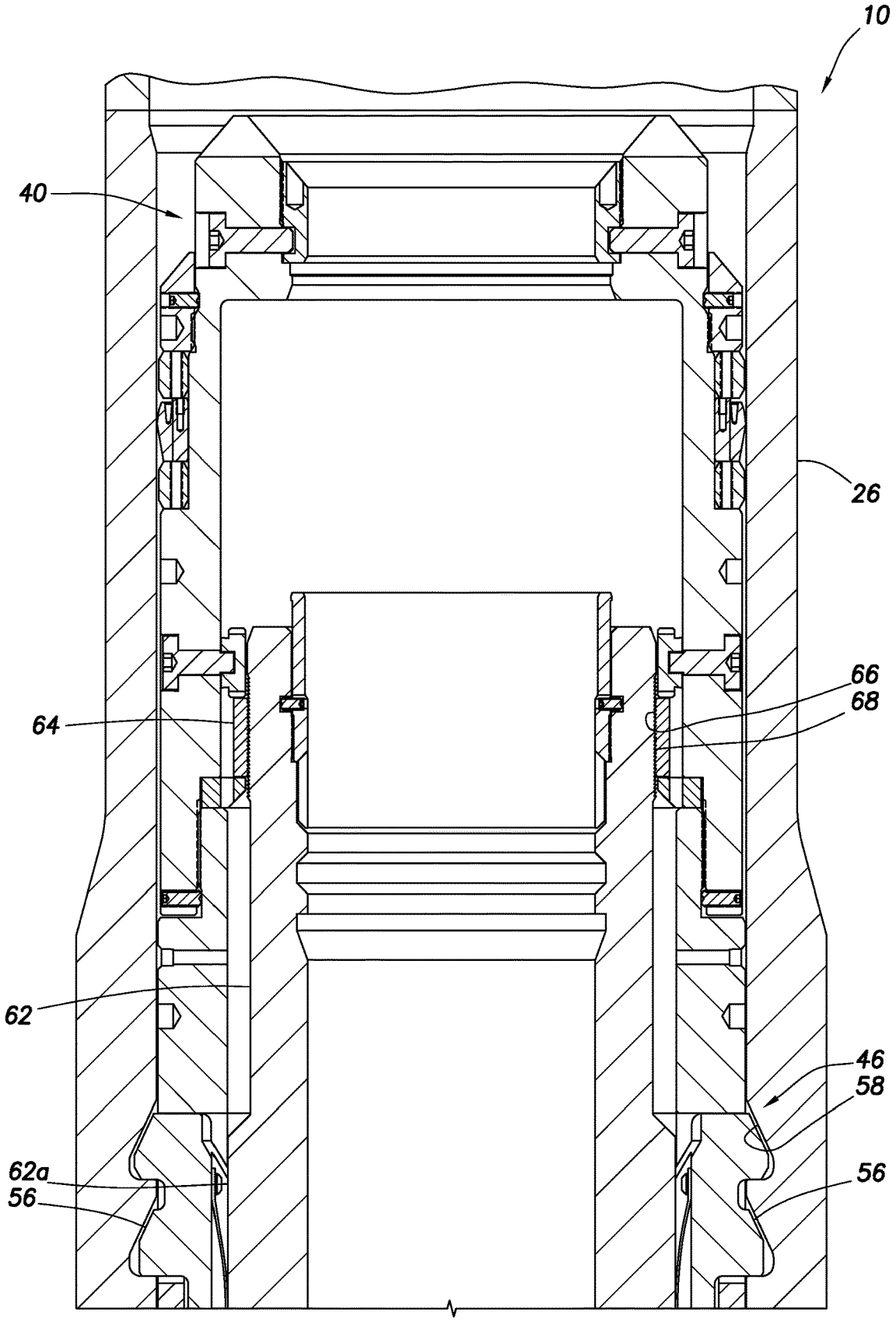
FIGS. 6A&B are representative cross-sectional views of the running tool longitudinally displaced relative to the rotating control device.
Figure 6B:
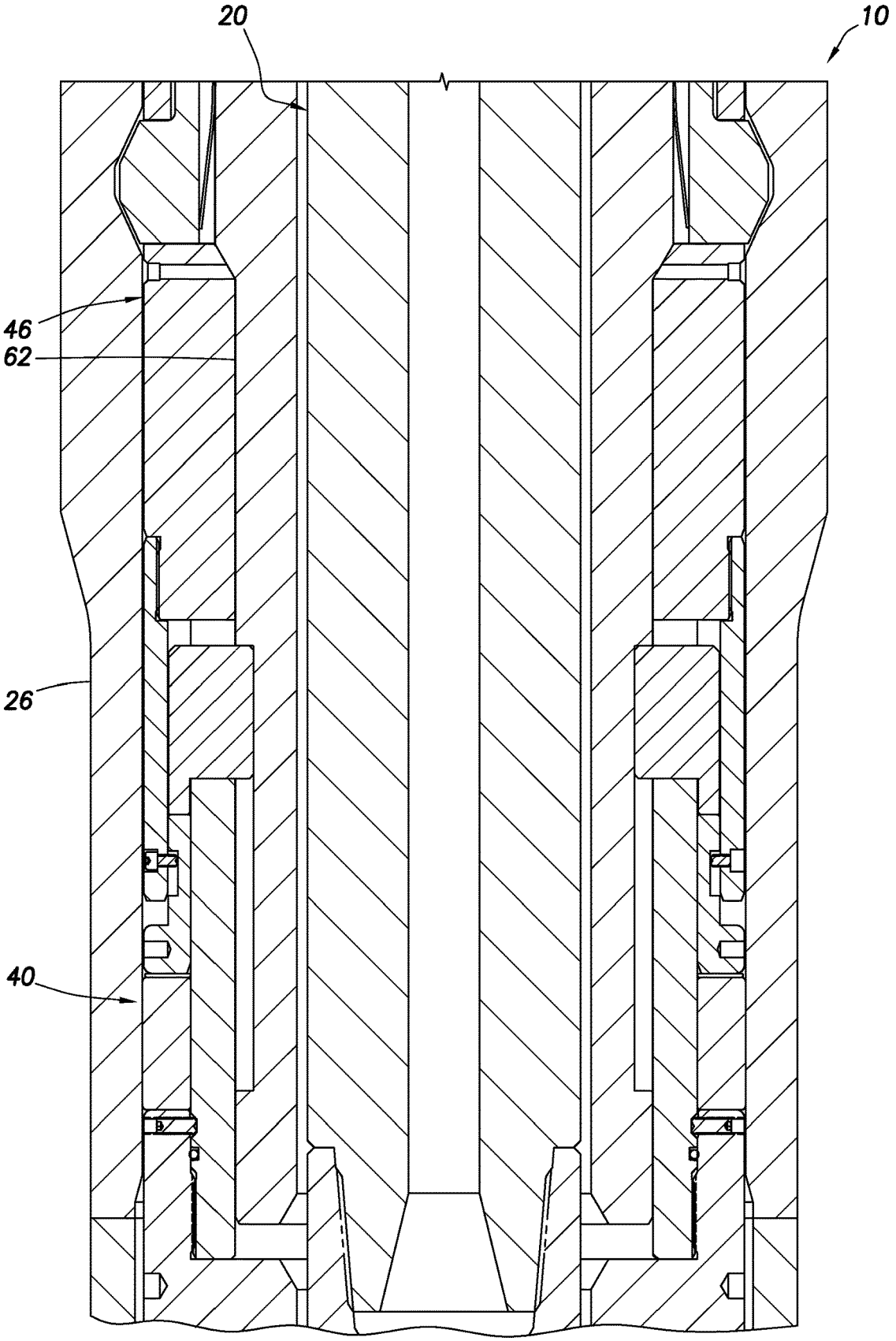

Referring additionally now to FIGS. 6A&B, the rotating control device 40 is representatively illustrated as fully installed in the riser housing 26. The tubular string 20 can now be displaced longitudinally upward and downward through the rotating control device 40 (for example, in drilling or other operations) while the annular seals 42 continue to seal off the annulus 34 between the riser housing 26 and the tubular string 20 as shown in FIG. 2E.

In order to retrieve the rotating control device 40 from the riser housing 26 (for example, to service or replace the seals 42 or the bearing assembly 44), the tubular string 20 can be displaced upwardly through the rotating control device 40, until the retrieval tool 52 engages the latch mandrel 62 of the rotating control device 40. This configuration is representatively illustrated in FIGS. 7A&B.

Figure 7A:
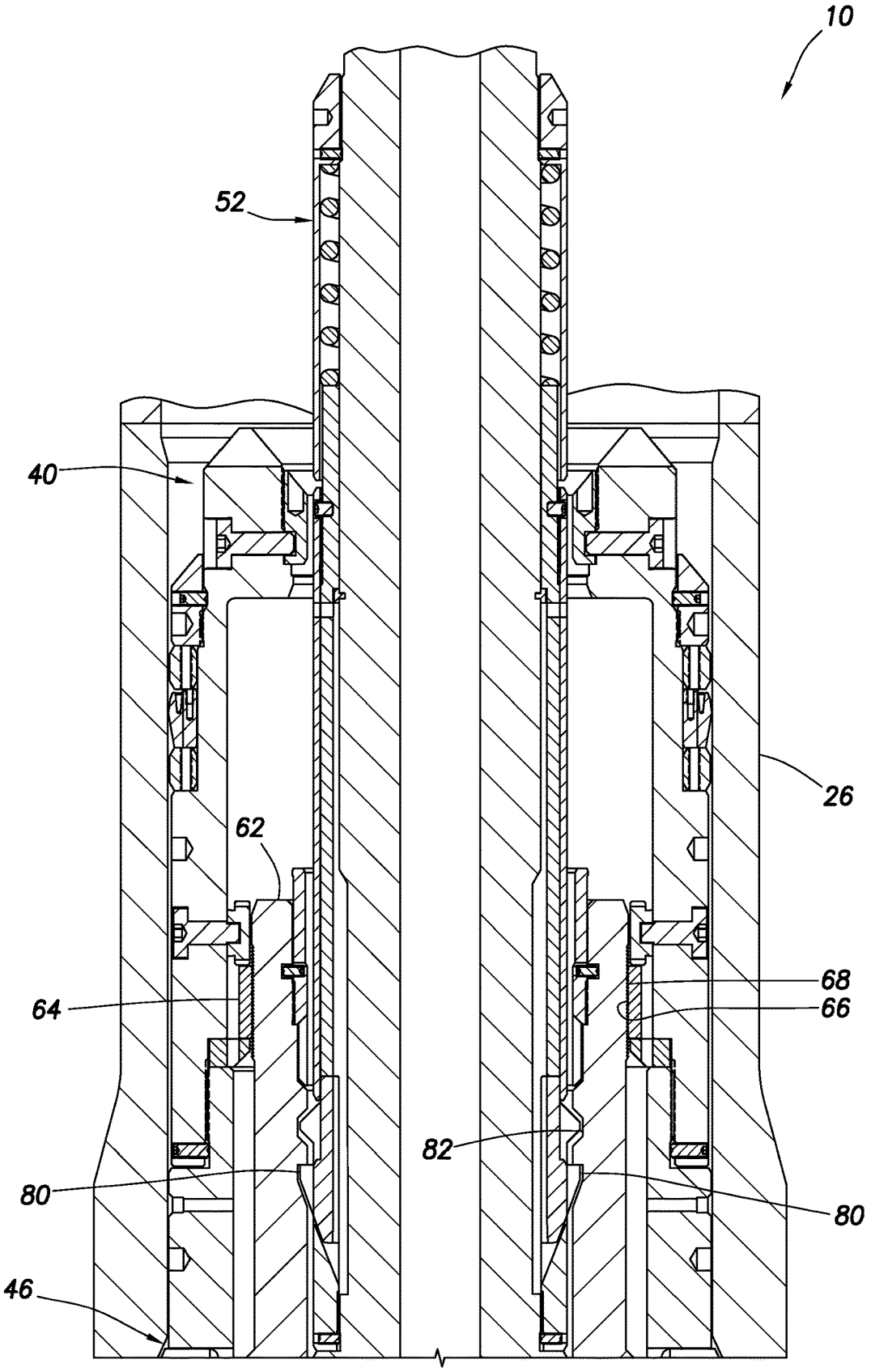
FIGS. 7A&B are representative cross-sectional views of a retrieval tool engaged with the latch assembly of the rotating control device.
Figure 7B:
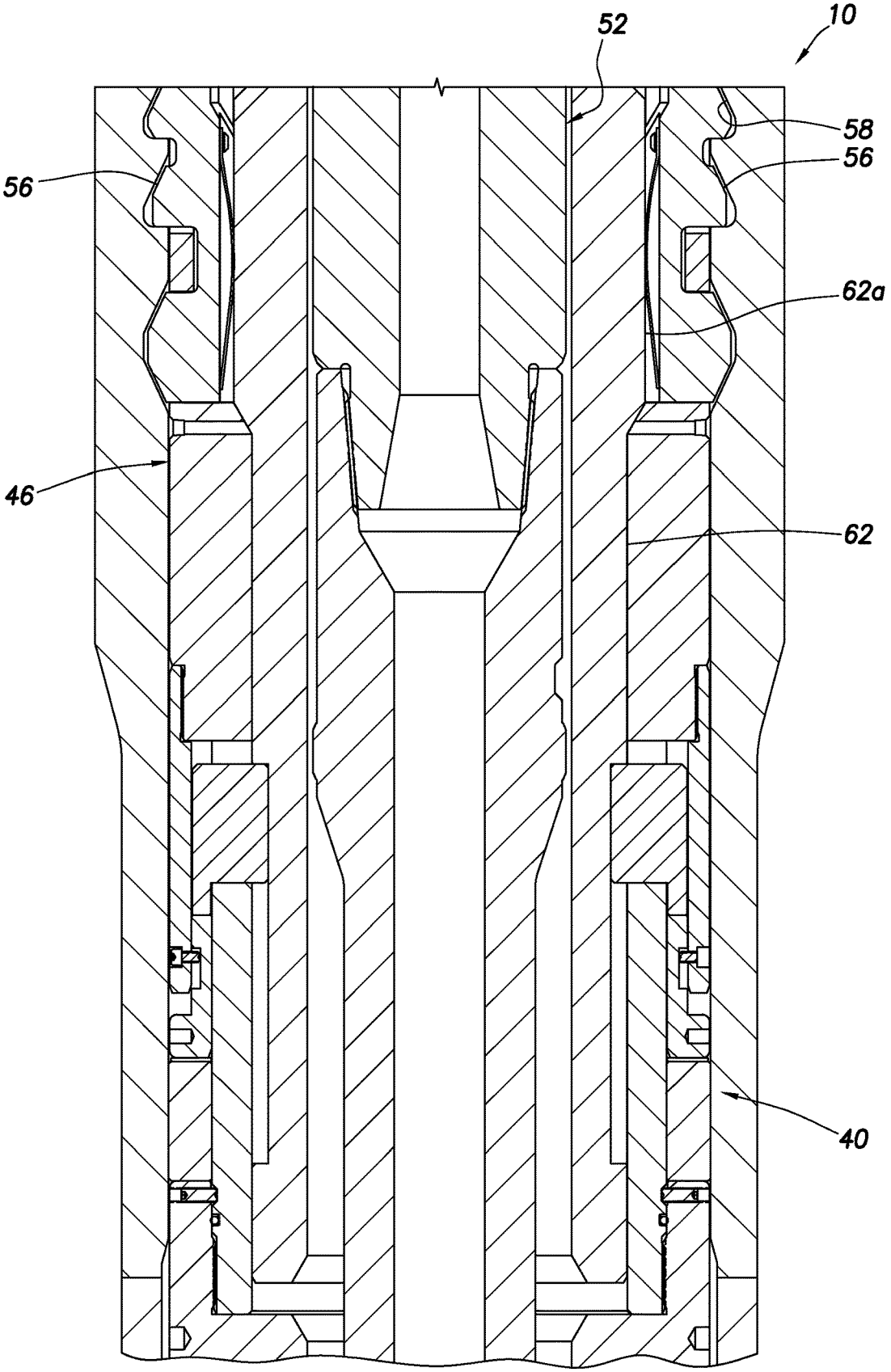

In FIG. 7A, it may be seen that engagement members 80 of the retrieval tool 52 in the form of outwardly biased resilient collets are engaged with an internal profile 82 formed in the inner mandrel 62 of the latch assembly 46. Such engagement allows the retrieval tool 52 to be used to upwardly displace the inner mandrel 62.

Figure 8A:
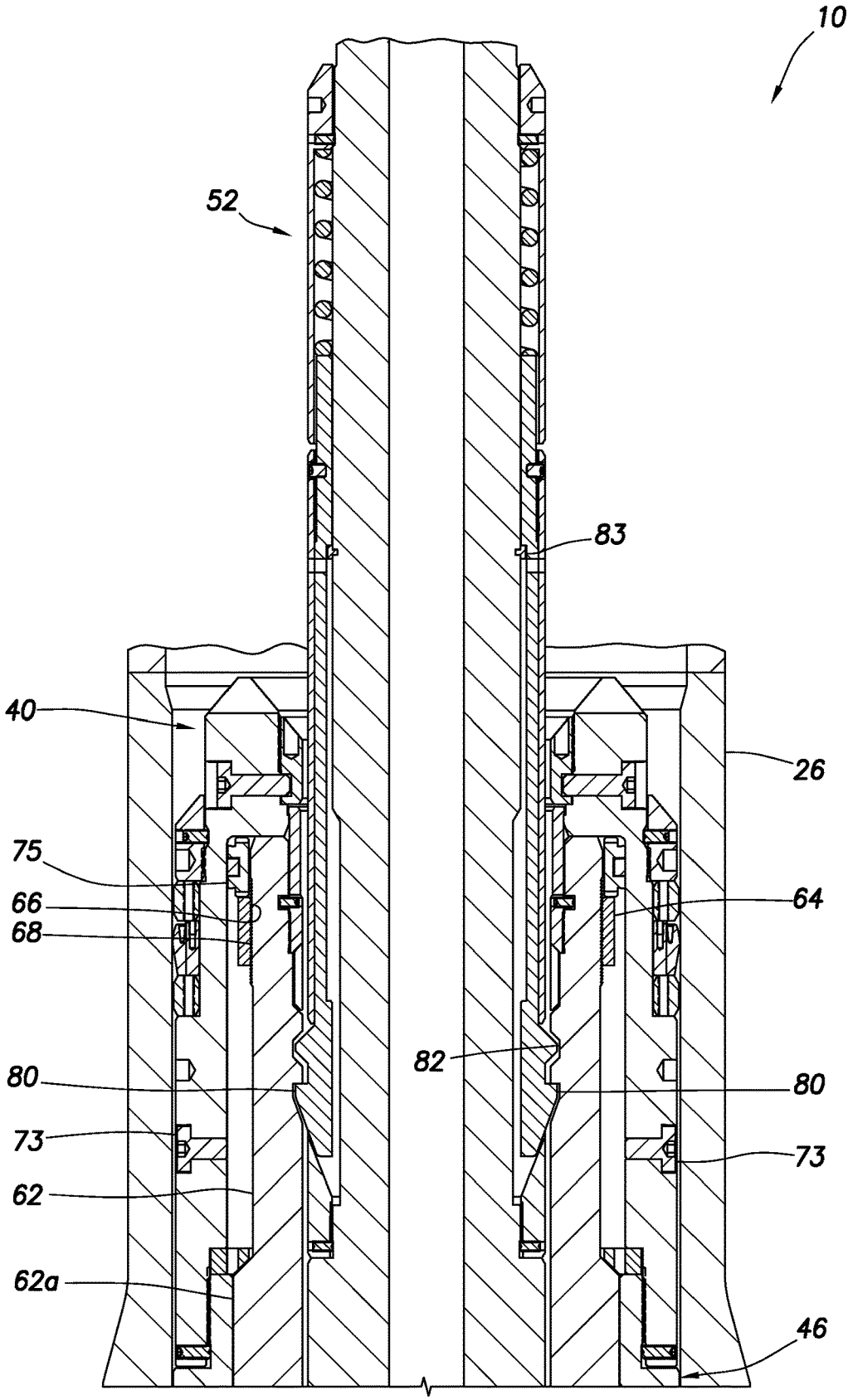
FIGS. 8A&B are representative cross-sectional views of the latch assembly of the rotating control device disengaged from the riser housing by the retrieval tool.
Figure 8B:
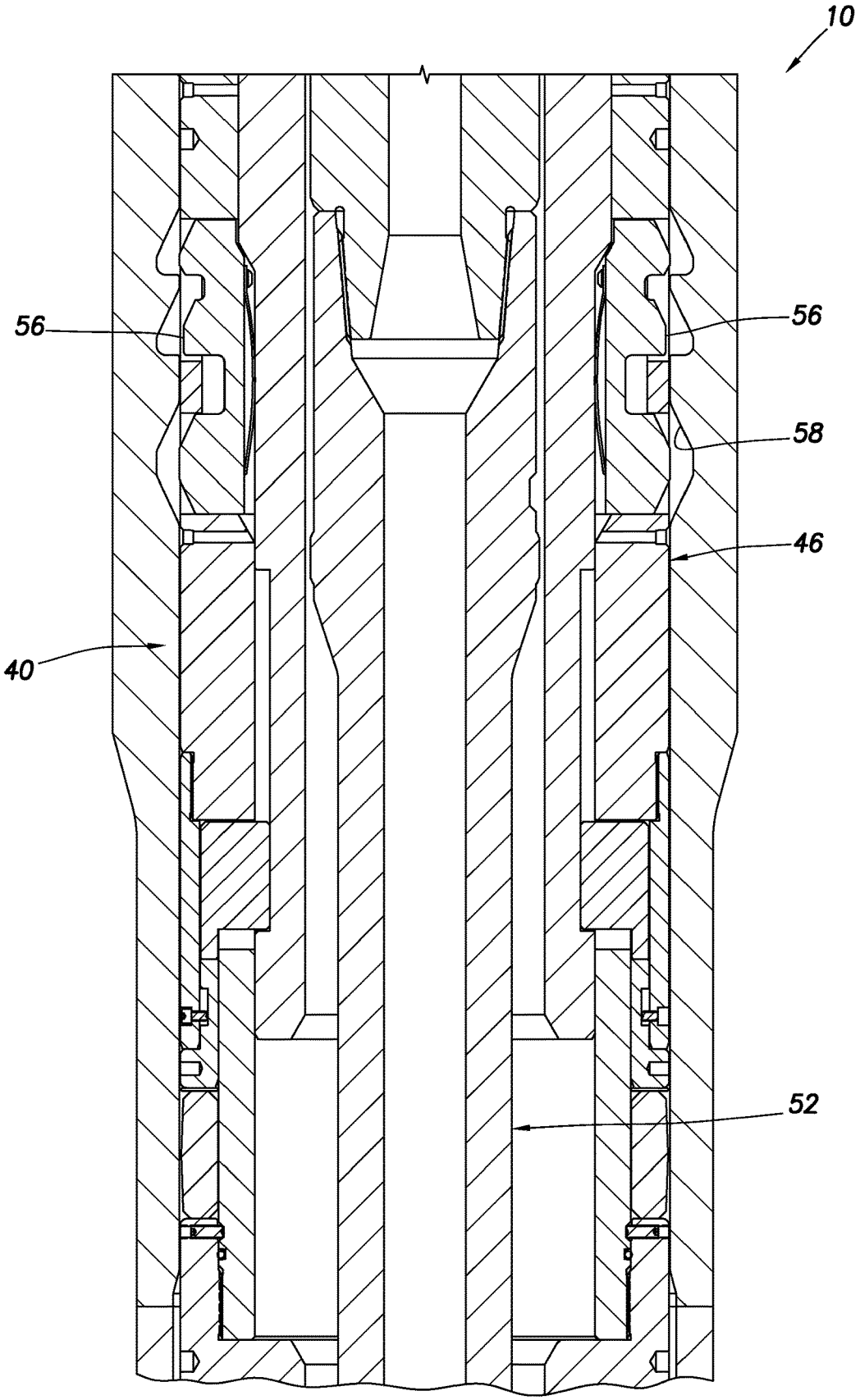

Referring additionally now to FIGS. 8A&B, the retrieval tool 52 displaces the inner mandrel 62 upwardly against the lock ring 64 and moves the latch release sleeve 75, causing the latch release pins 73 to be sheared. As a result, the radially enlarged portion 62*a* of the inner mandrel 62 no longer outwardly supports the latch members 56, so that the latch members can now radially retract out of engagement with the internal profile 58 of the riser housing 26.

Although the latch members 56 may still be biased outwardly, the configurations of the latch members and the internal profile 58 are such that the latch members will retract inward when the retrieval tool 52 is displaced upward relative to the riser housing 26. Thus, the rotating control device 40, along with the retrieval tool 52 (and the remainder of the tubular string 20) can now be retrieved from the riser housing 26 (and the remainder of the riser string 12).

Figure 9A:
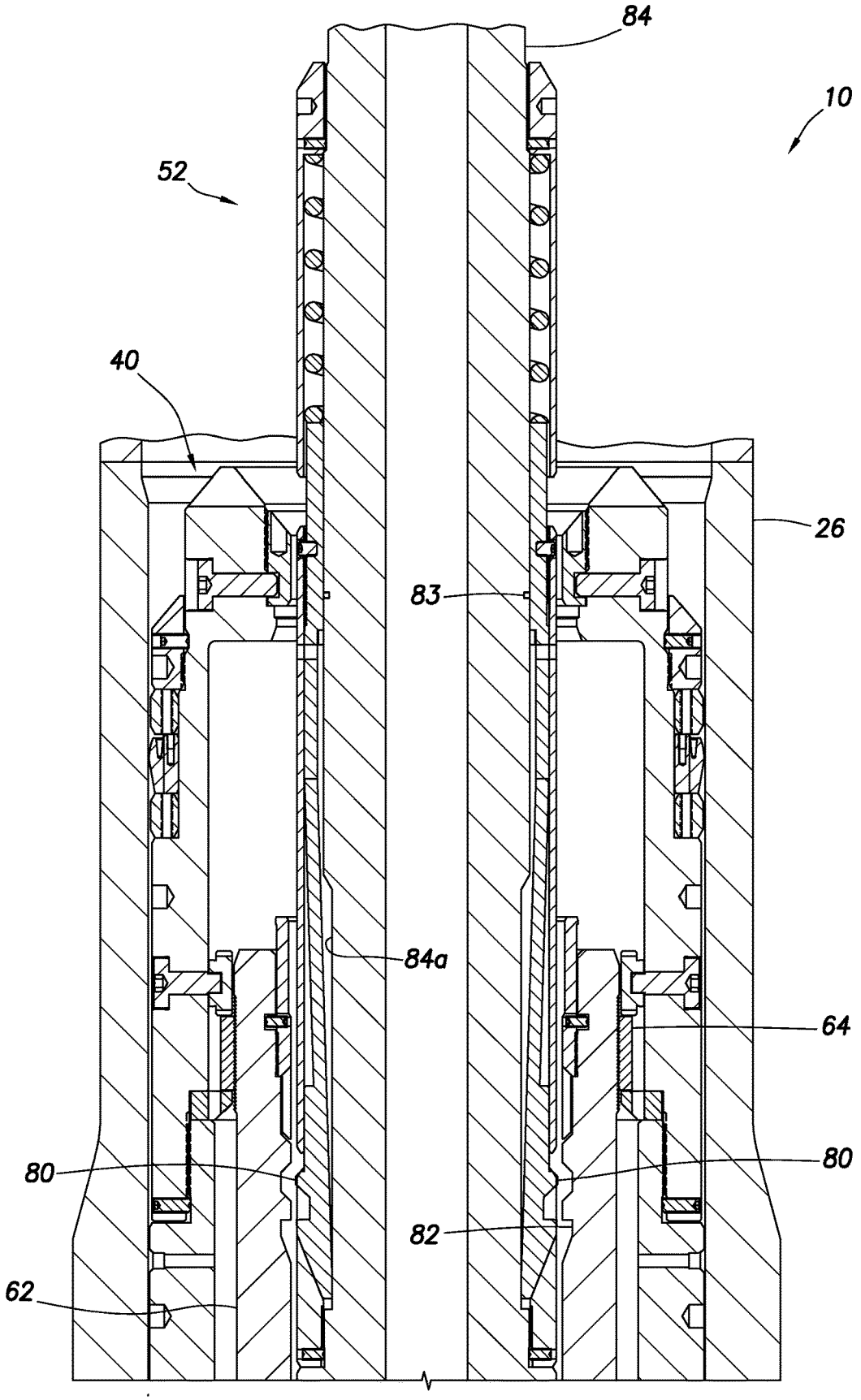
FIGS. 9A&B are representative cross-sectional views of a contingency release of the retrieval tool from the latch assembly of the rotating control device.
Figure 9B:
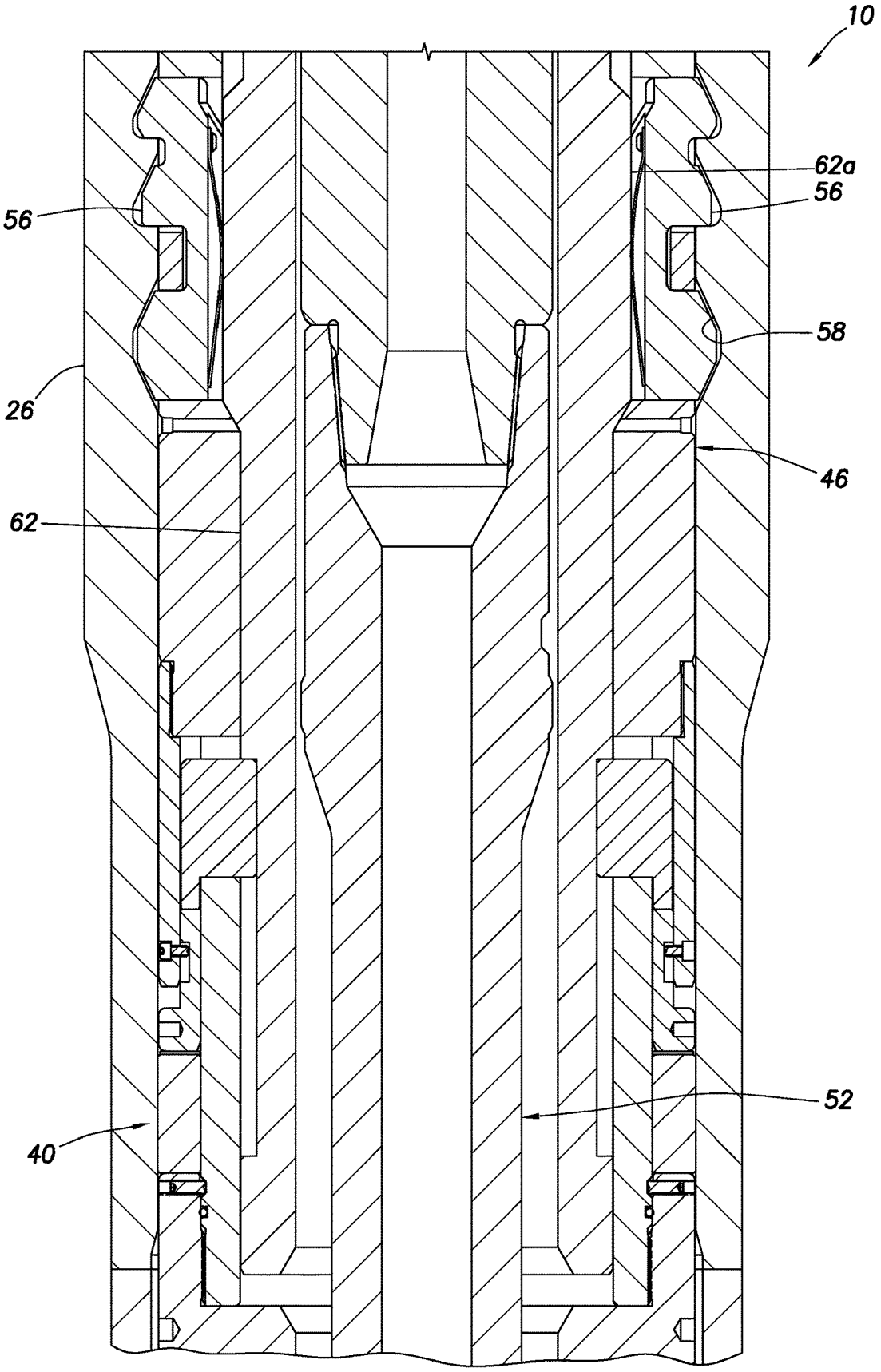

Referring additionally now to FIGS. 9A&B, a contingency release technique is representatively illustrated. In the event that the inner mandrel 62 cannot be displaced upward by the retrieval tool 52, a contingency technique may be utilized to permit the retrieval tool 52 to be released from the rotating control device 40, so that the tubular string 20 can be retrieved from the well.

In FIG. 9A, note that a predetermined upward force is required to shear the release ring 83, and it is applied to the inner mandrel 84 of the retrieval tool 52. This enables the inner mandrel 84 to be displaced upwardly relative to the engagement members 80 (which previously remained engaged with the internal profile 82). A radially reduced portion 84*a* of the inner mandrel 84 is now adjacent to the engagement members 80, thereby allowing the engagement members 80 to retract inwardly out of engagement with the internal profile 82.

The retrieval tool 52 and the remainder of the tubular string 20 may now be retrieved from the well, leaving the rotating control device 40 installed in the riser housing 26. Other tools (such as hydraulic jars, spears, etc.) may be used to retrieve the rotating control device 40 from the riser housing 26.

Figure 10A:
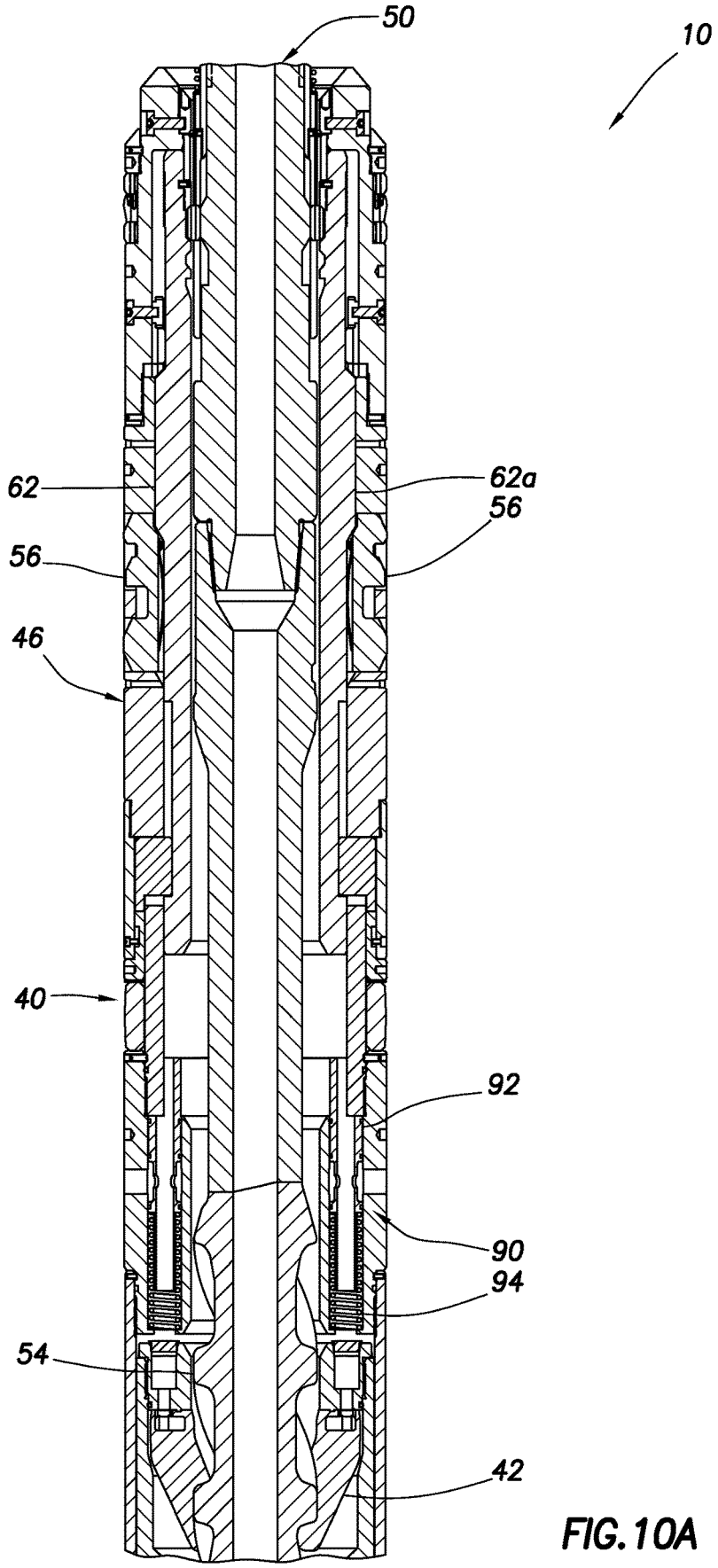
FIGS. 10A&B are representative cross-sectional views of another example of the rotating control device including an equalization valve in respective open and closed configurations.

Referring additionally now to FIGS. 10A&B, another example of the rotating control device 40 is representatively illustrated. In this example, the rotating control device 40 includes an equalization valve 90 that can be used to prevent a pressure differential from existing across the rotating control device 40 when it is retrieved from the riser housing 26 (not shown).

In FIG. 10A, the rotating control device 40 and running tool 50 are depicted in a configuration in which the running tool 50 conveys the rotating control device 40 into the riser housing 26. Note that the latch members 56 are not radially outwardly supported by the radially enlarged portion 62*a* of the inner mandrel 62.

The equalization valve 90 in FIG. 10A is in an open configuration, thereby permitting fluid communication between an interior and an exterior of the rotating control device 40. This prevents a buildup of differential pressure across the rotating control device 40.

Figure 10B:
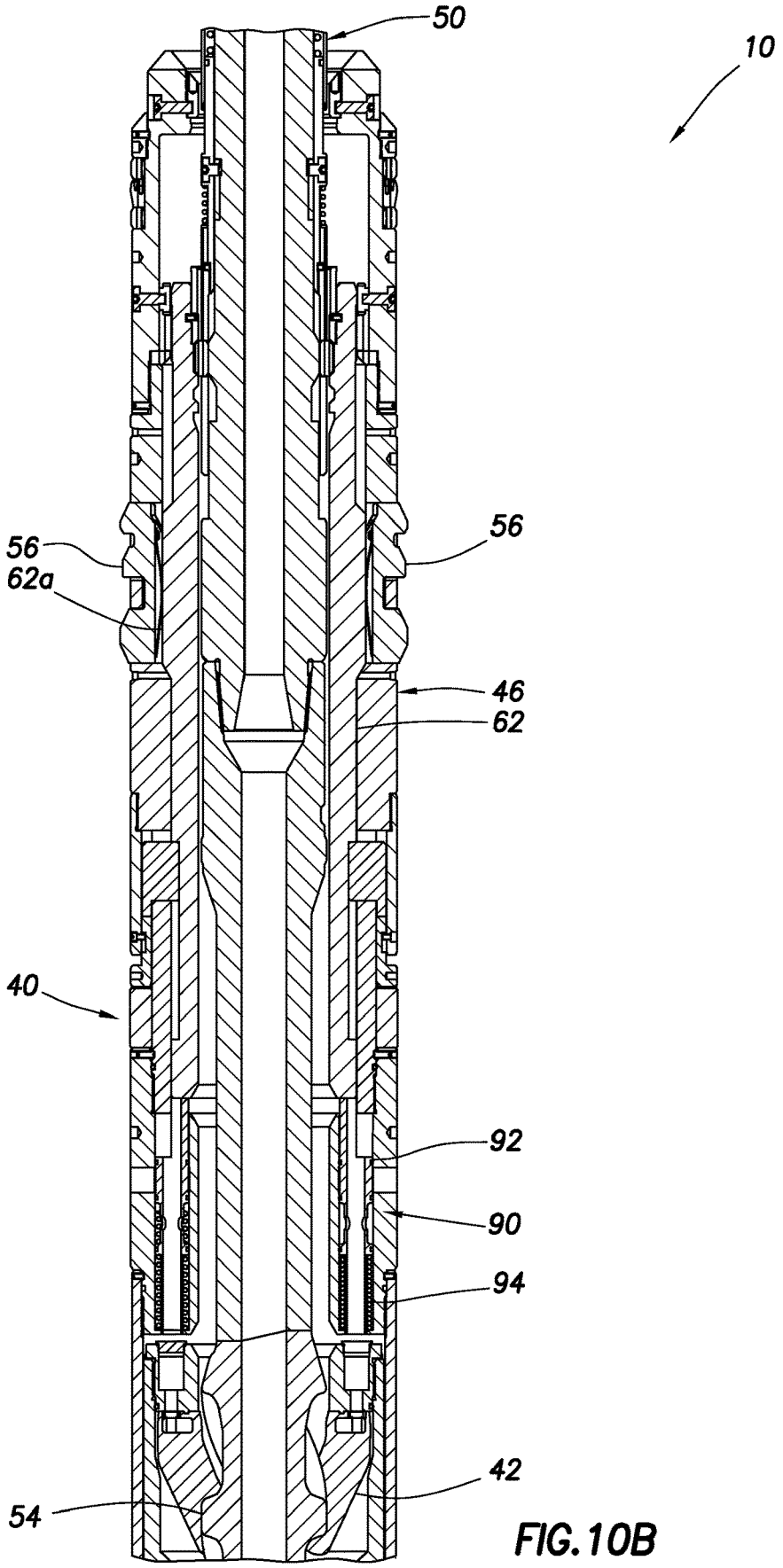

In FIG. 10B, the rotating control device 40 and running tool 50 are depicted in a configuration in which the rotating control device 40 has been secured in the riser housing 26 by engaging the latch members 56 with the internal profile 58 and displacing the inner mandrel 62 downward, so that the latch members 56 are radially outwardly supported by the radially enlarged portion 62*a* of the inner mandrel (see FIGS. 4A&B; the riser housing 26 is not depicted in FIG. 10B for clarity).

The equalization valve 90 in FIG. 10B is in a closed configuration, thereby preventing fluid communication between the interior and exterior of the rotating control device 40. This allows the sealing engagement between the annular seals 42 and the tubular string 20 to effectively seal off the annulus 34 (see FIG. 1), with a pressure differential across the rotating control device 40.

Note that the equalization valve 90 includes a closing piston 92 that is upwardly biased by a biasing device 94. The closing piston 92 in this example is in the form of a sleeve, but in other examples other types of closing pistons may be used (such as, plugs, flappers, etc.). When the inner mandrel 62 displaces downwardly from its FIG. 10A position to its FIG. 10B position, the inner mandrel 62 contacts the closing piston 92 and displaces it downward against a biasing force exerted by the biasing device 94.

Conversely, when the inner mandrel 62 is displaced upward by the retrieval tool 52 (as described above in relation to FIGS. 7A-8B), the biasing device 94 will upwardly displace the closing piston 92 as the inner mandrel 62 displaces upward. In this manner, the equalization valve 90 closes when the inner mandrel 62 displaces downward, and the equalization valve opens when the inner mandrel displaces upward.

The inner mandrel 62 and equalization valve 90 are appropriately dimensioned, so that the equalization valve 90 does not close until the inner mandrel 62 has displaced downward a sufficient distance for the radially enlarged portion 62*a* to outwardly support the latch members 56. Furthermore, during retrieval of the rotating control device 40 from the riser housing 26, the equalization valve 90 opens prior to the latch members 56 being permitted to disengage from the internal profile 58 in the riser housing 26. This prevents any pressure differential from existing across the rotating control device 40 while the latch members 56 are not maintained in engagement with the internal profile 58.

Referring additionally now to FIGS. 11A-14D, operational sequences are representatively depicted for several different examples of the release mechanism 60 that effectuates the release of the running tool 50 from the rotating control device 40. In all instances, these configurations allow for a rotational release method of the running tool 50 from the rotating control device 40. As described above for FIGS. 2A-5B, the inner mandrel 48 of running tool 50 can displace upward relative to release members 74 and when aligned with reduced portion 48*a* of inner mandrel 48, the release members 74 will disengage from the rotating control device 40. This action only occurs when the pins 70 are aligned with the longitudinally extending slots 72 (see, e.g., FIGS. 4A & 5A).

FIGS. 11A-14D illustrate different examples for how such an alignment and the corresponding displacement of the inner mandrel 48 may be accomplished to achieve release of the running tool 50. It should be understood that the scope of this disclosure is not limited to just these examples.

The pins and slots shown in FIGS. 11A-D are configured for those same items shown in FIGS. 2A-5B. A top view of only one of the pins 70 and slots 72 are depicted in FIGS. 11A-14D. They are viewed perpendicular to the surface of the inner mandrel 48 of the running tool 50.

Figure 11A:
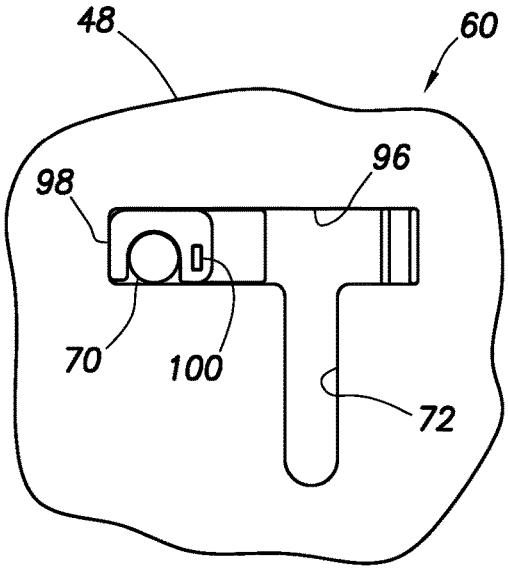
FIGS. 11A-D are enlarged representative side views of operational configurations of a release control device of the running tool.

The release mechanism 60 of running tool 50 shown in FIG. 11A corresponds to the running tool 50 being in a run-in configuration supporting the weight of the rotating control device 40 as it is lowered into the well. The pin 70 and retainer collet 98 are received in a circumferentially extending slot 96 formed on the inner mandrel 48. The circumferentially extending slot 96 intersects the longitudinally extending slot 72 in FIG. 11A.

The pin 70 is retained in a position of misalignment with slot 72 to prevent premature release of the rotating control device 40 while running in the well. It is retained by a shear member 100 which is located in the retainer collet 98 and extends into the inner mandrel 48. The retainer collet 98 partially encircles pin 70. The shear member 100 initially prevents circumferential displacement of the inner mandrel 48 relative to the trapped pin 70 and retainer collet 98.

Figure 3B:
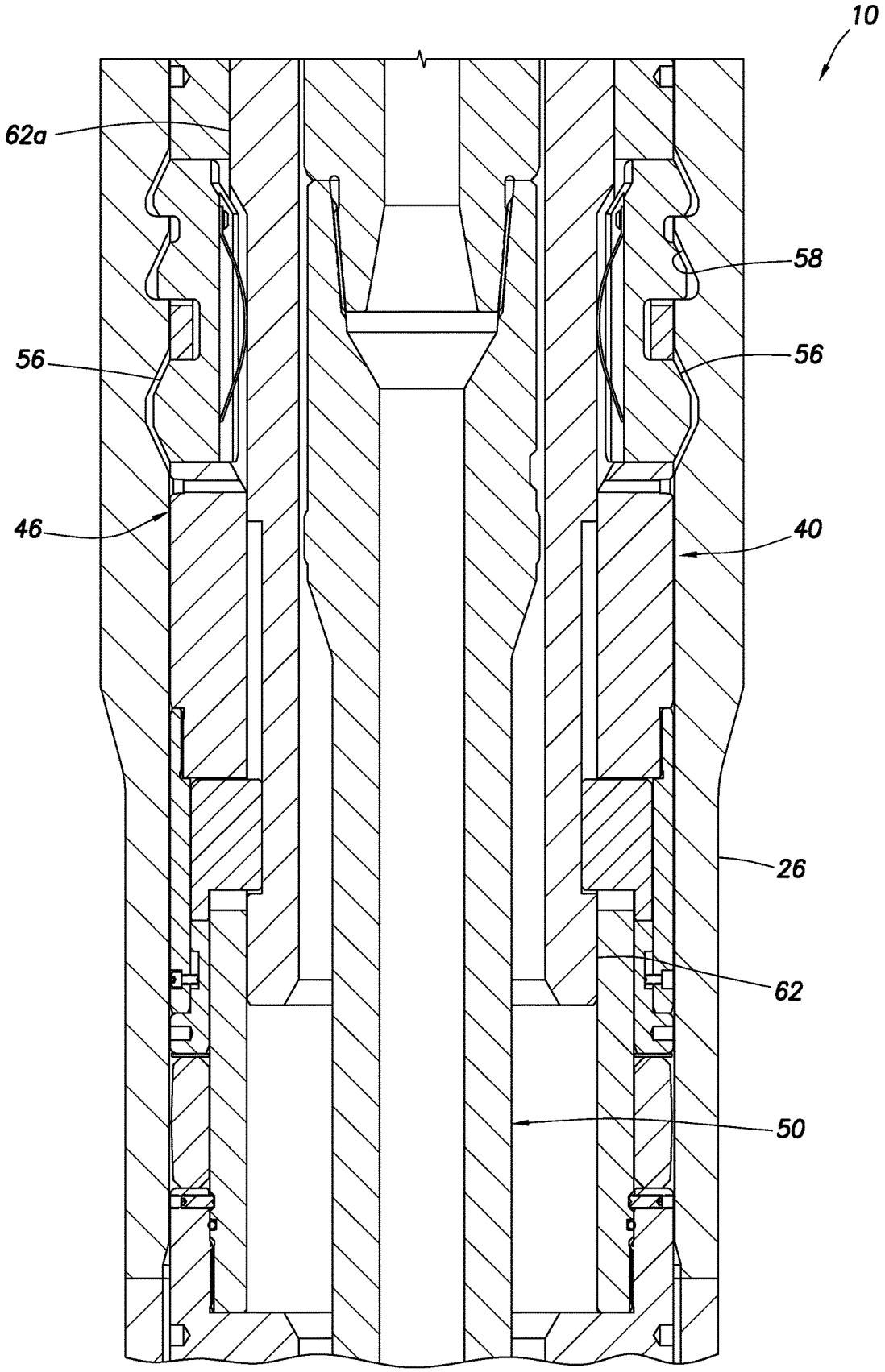

Since the pin 70 is not aligned with the slot 72 in FIG. 11A, the inner mandrel 48 cannot displace upward relative to the release members 74. Also, slot 72 in the inner mandrel 48 cannot be rotated toward pin 70 and retainer collet 98 until shear member 100 has been sheared. As can be seen in FIG. 3A and 3B, a sleeve 86 in which the release members 74 are received is secured relative to the pins 70, and so the inner mandrel 48 cannot displace longitudinally relative to the release members 74 while the pin 70 is positioned in the slot 96 as depicted in FIG. 11A.

Figure 11B:
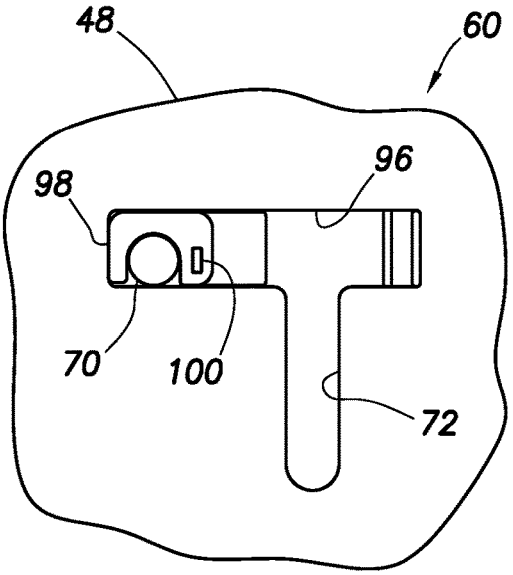

The release mechanism 60 shown in FIG. 11B corresponds to the running tool 50 configuration of FIGS. 3A&B, in which the latch members 56 of the rotating control device 40 have engaged the internal profile 58 in the riser housing 26. In this configuration, the pin 70 remains circumferentially spaced apart from the slot 72, as in the configuration of FIG. 11A. This configuration of the running tool 50 identifies the position as it first locates in riser housing 26. The rotating control device 40 has not yet been secured in the riser housing 26.

Figure 11C:
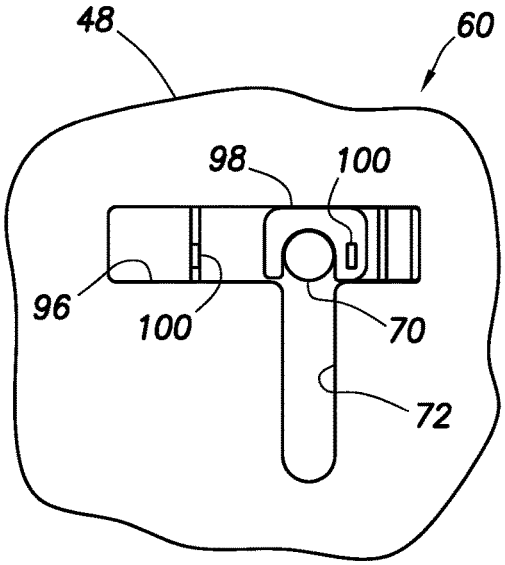

The release mechanism 60 shown in FIG. 11C corresponds to the running tool 50 configuration of FIGS. 4A&B, in which the rotating control device 40 has been secured in the riser housing 26 and the inner mandrel 48 of the running tool 50 has been rotated circumferentially clockwise as viewed from above. As a result of this rotation, the shear member 100 has been properly sheared and the pin 70 and retainer collet 98 have been properly aligned in preparation for release from the rotating control device 40.

Note that the pin 70 is now aligned with the slot 72. In this configuration, the inner mandrel 48 can now displace upward relative to the pin 70 and the release members 74. The nose of the retainer collet 98 has engaged a perpendicular groove in slot 96 in which it will not allow the pin 70 to come out of alignment with slot 72. This is needed in the event of any motion in the drill string or back torque from the shear release member 100. The pin 70 will remain in a release position until the inner mandrel 48 is pulled upwardly to release the running tool 50 from the rotating control device 40.

Figure 11D:
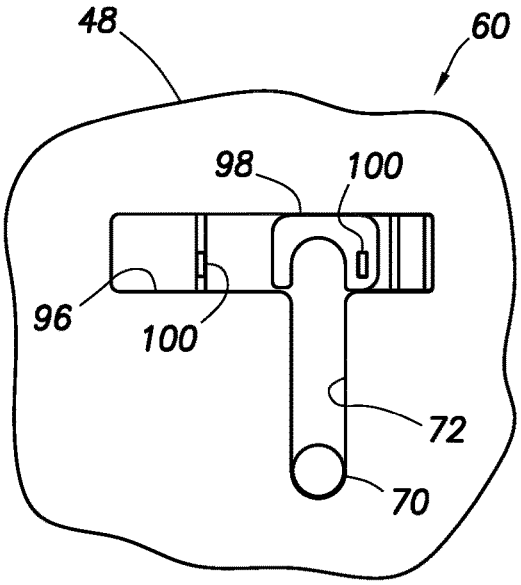
Figure 12D:
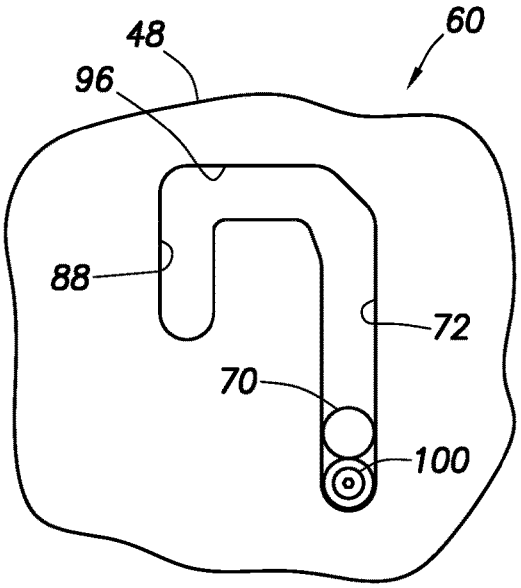
Figure 13D:
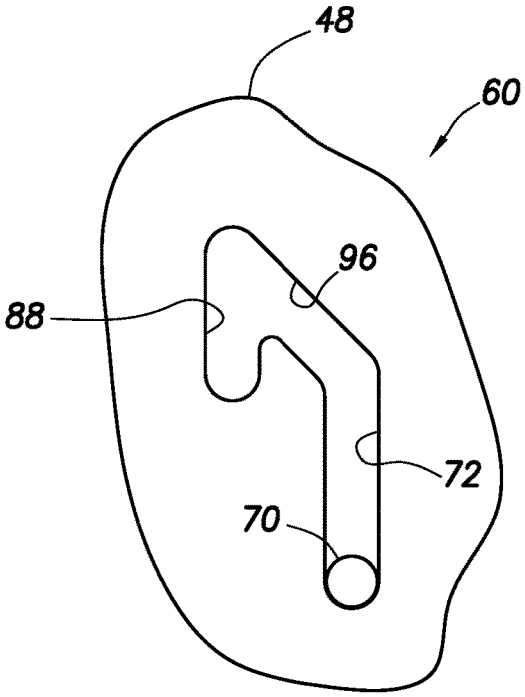
Figure 14D:
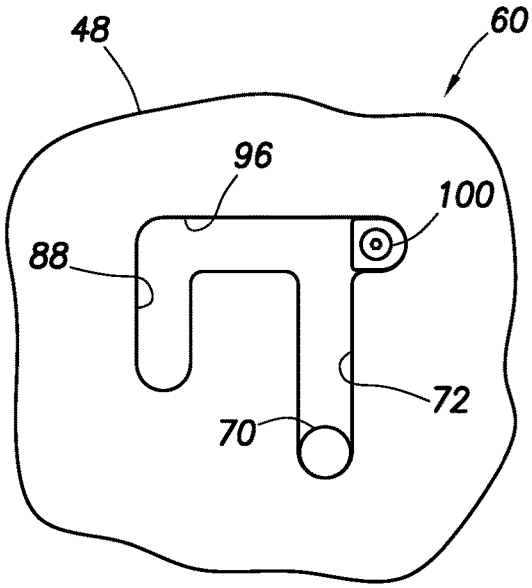
Figure 15A:
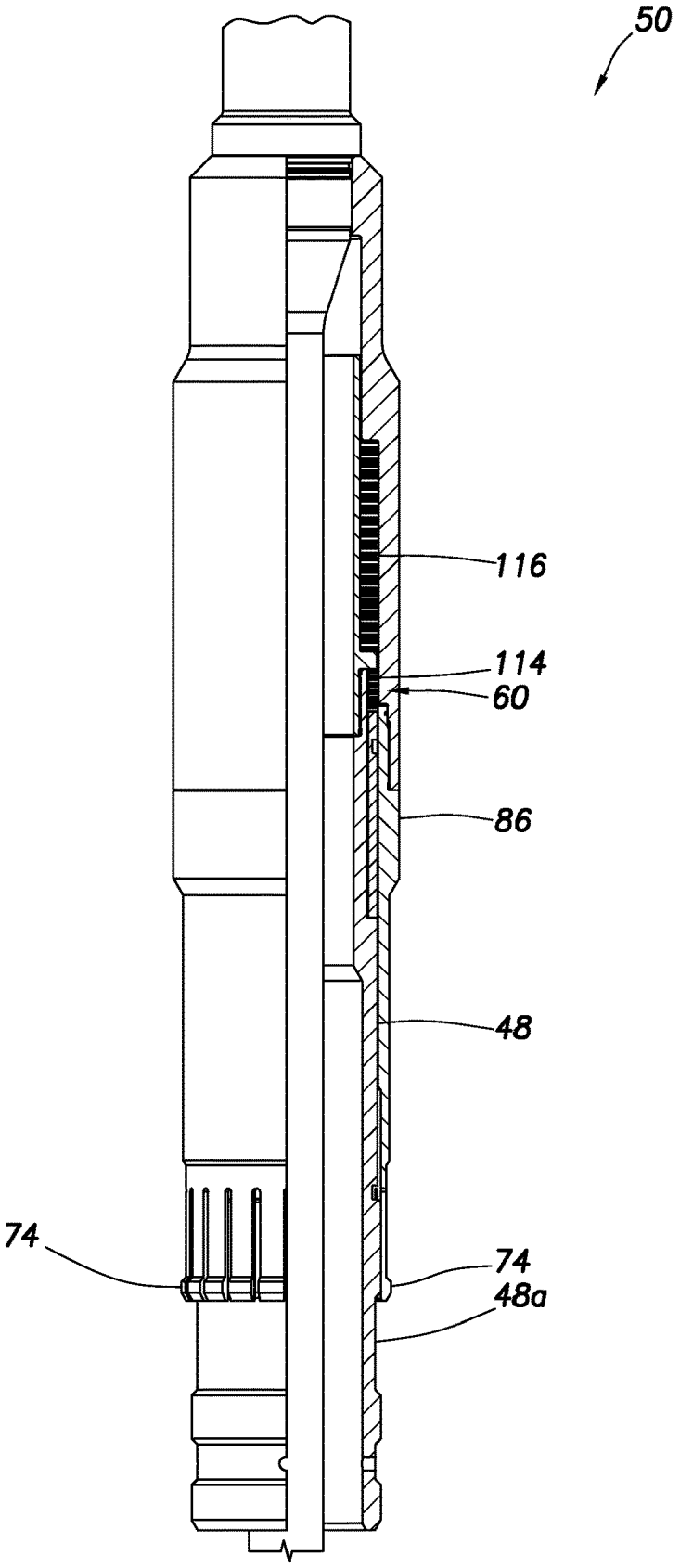
FIGS. 15A&B are representative partially cross-sectional views of another example of the running tool.
Figure 15B:
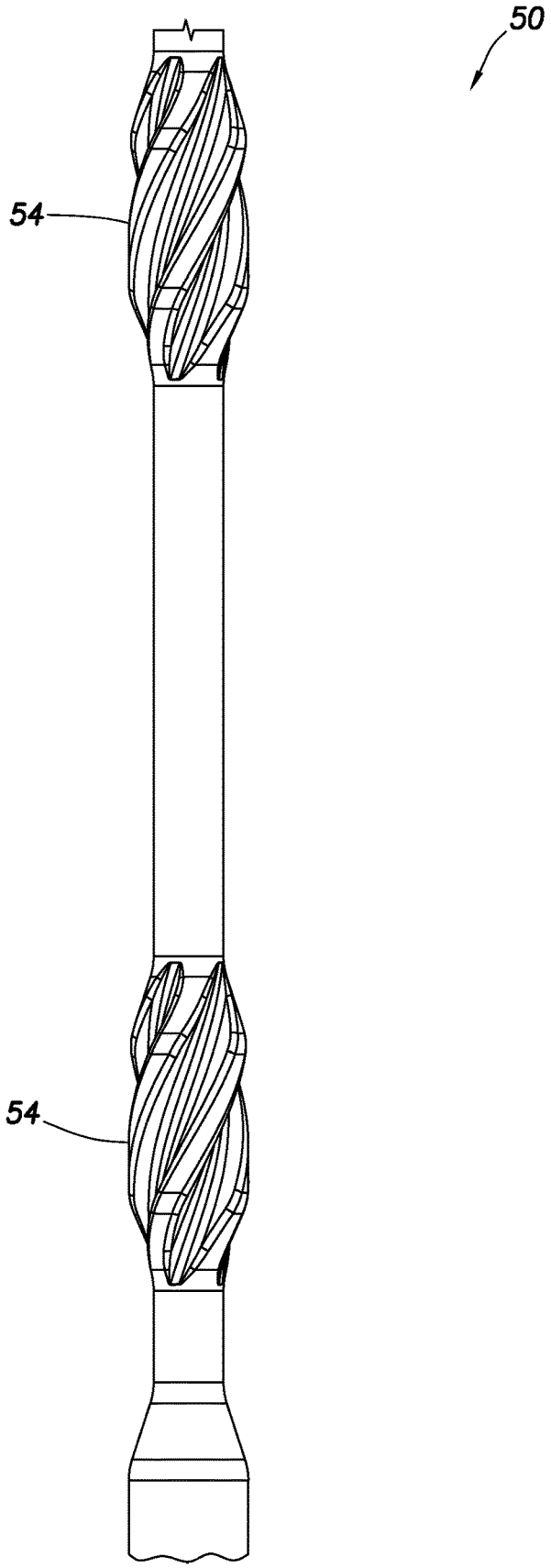
Figure 16:
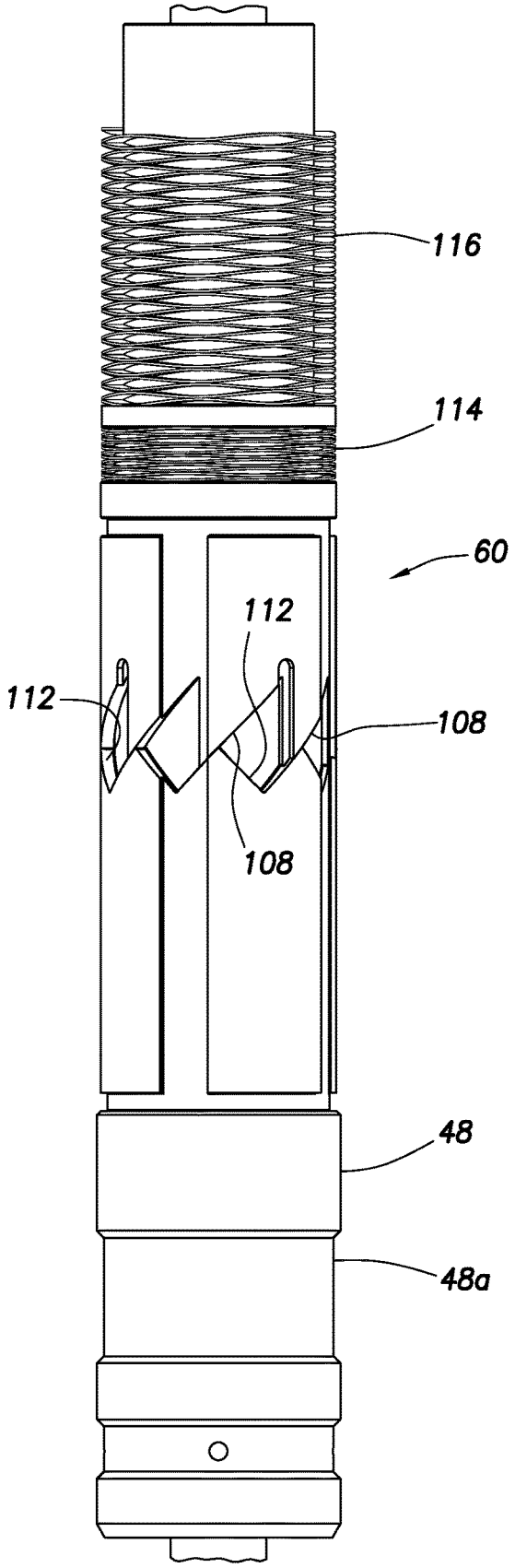
FIG. 16 is a representative side view of interior components of the running tool of FIG. 15.
Figure 17:
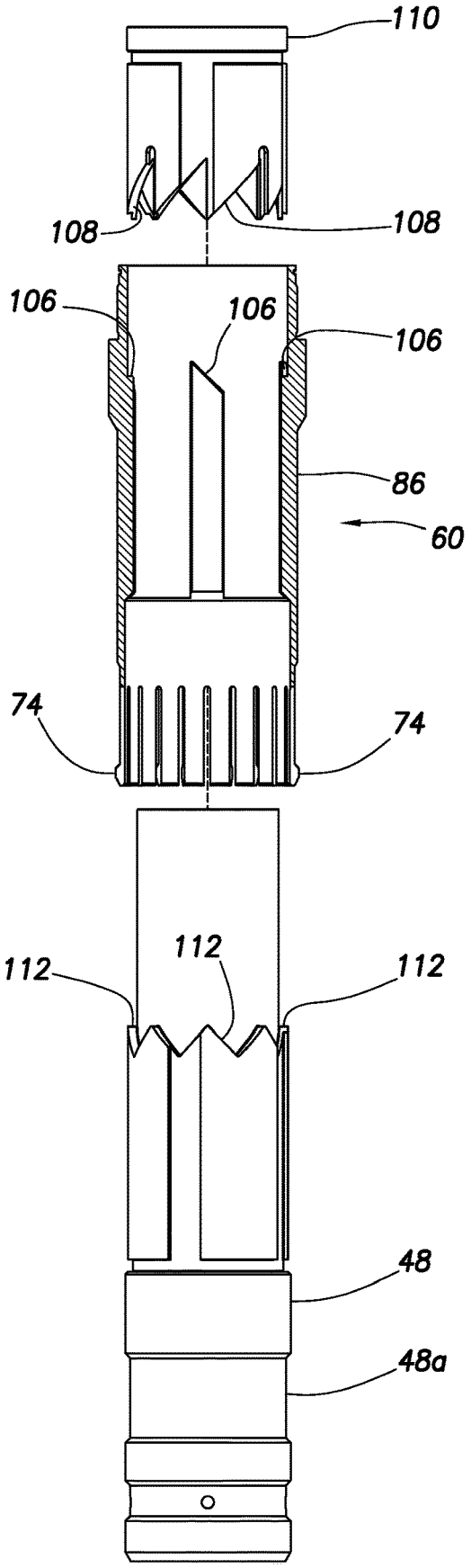
FIG. 17 is a representative partially cross-sectional exploded view of some of the interior components of the running tool.

The release mechanism 60 shown in FIG. 11D corresponds to the running tool 50 configuration of FIGS. 5A&B, in which the inner mandrel 48 of the running tool 50 has been displaced upward, thereby causing the release members 74 to retract inwardly, and thereby enabling the release of the running tool 50 from the rotating control device 40.

Figure 12A:
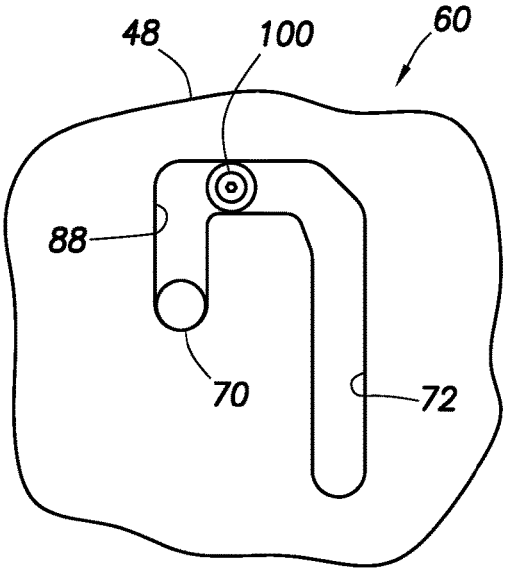
FIGS. 12A-D are representative side views of operational configurations of another example of the release control device.
Figure 13A:
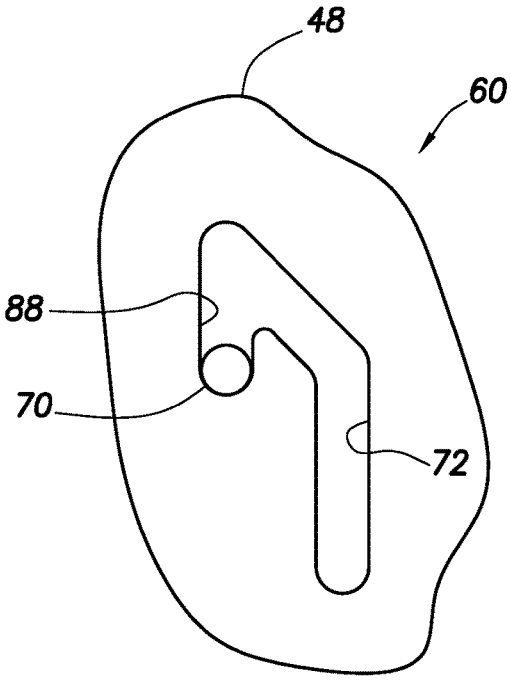
FIGS. 13A-D are representative side views of operational configurations of another example of the release control device.
Figure 14A:
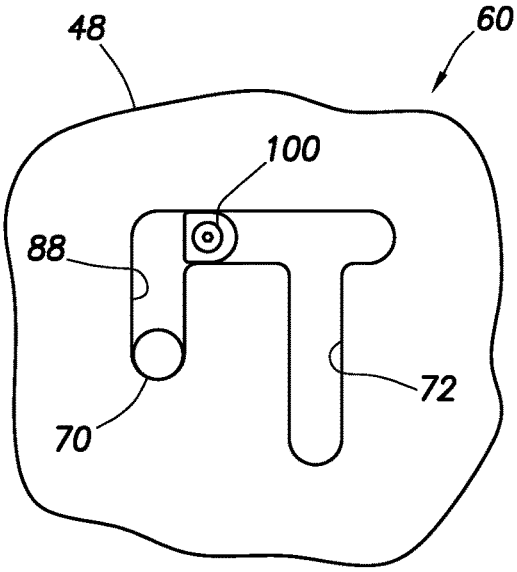
FIGS. 14A-D are representative side views of operational configurations of another example of the release control device.

The release mechanism 60 examples of FIGS. 12A-14D are somewhat similar to each other, in that they incorporate variations of a slot configuration known to those skilled in the art as a "J-slot." In these examples, the FIGS. 12A, 13A & 14A configurations correspond to the FIGS. 2A-E configuration of the running tool 50. The FIGS. 12B, 13B & 14B configurations correspond to the FIGS. 3A&B configuration of the running tool 50. The FIGS. 12C, 13C & 14C configurations correspond to the FIGS. 4A&B configuration of the running tool 50. The FIGS. 12D, 13D & 14D configurations correspond to the FIGS. 5A&B configuration of the running tool 50.

Figure 12B:
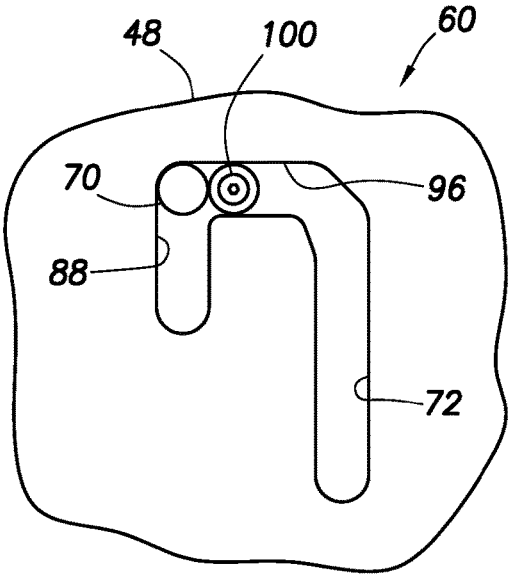
Figure 13B:
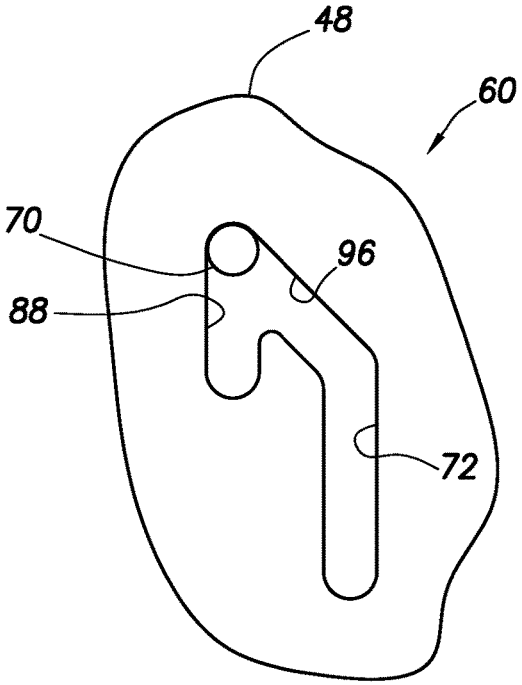
Figure 14B:
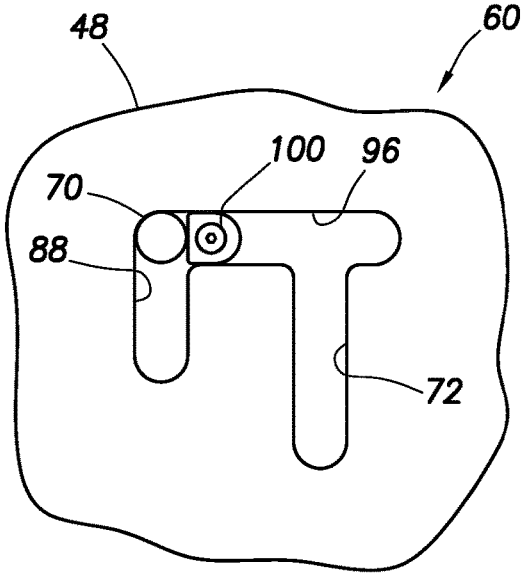

Note that, in the FIGS. 12B, 13B & 14B configurations, the inner mandrel 48 is displaced downward relative to the pin 70, so that the pin traverses a longitudinally extending slot 88 and is now aligned with the circumferentially extending slot 96. This is accomplished in the FIGS. 3A&B configuration of the running tool 50 by applying downward force (e.g., "set down" weight) to the running tool 50 after the latch members 56 have cooperatively engaged the internal profile 58 of the riser housing 26.

Slot 88 is primarily needed to carry the weight of the rotating control device 40 in the well for the configuration of FIG. 13B. Since the pin 70 is not trapped by a shearing member for FIG. 13B, the pin 70 may allow premature release of the rotating control device 40 while running in the well by becoming aligned with slot 72. Slot 88 is also used to test the rotating control device 40 for proper engagement by pulling up with the running tool 50 or by setting down weight with the running tool 50 to make sure the rotating control device 40 is securely engaged in the riser housing 26. This is performed prior to shearing the shear member 100 to release the running tool 50 from the rotating control device 40.

Figure 12C:
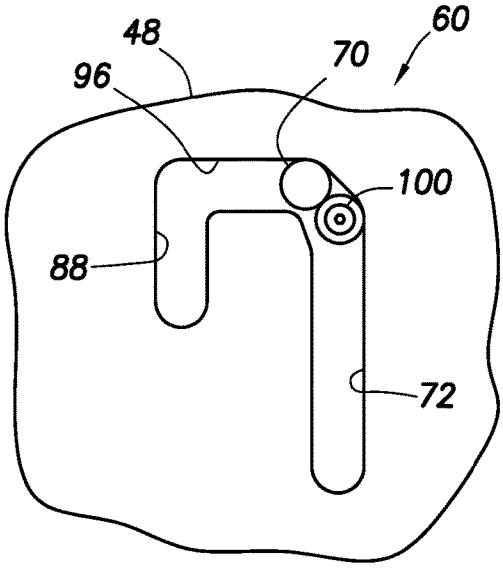
Figure 13C:
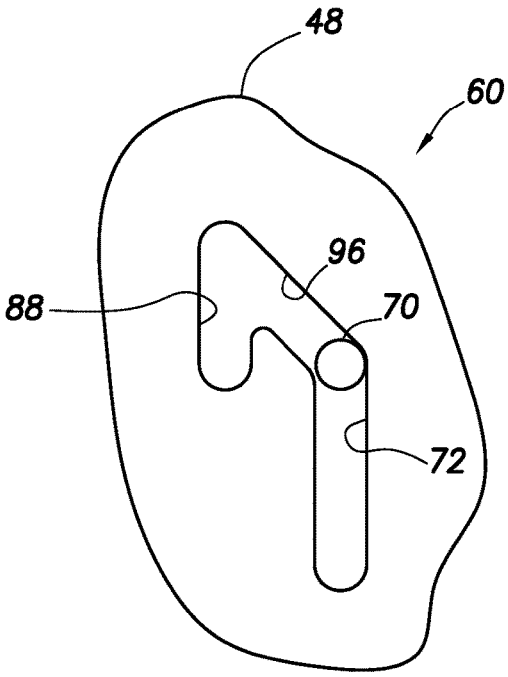
Figure 14C:
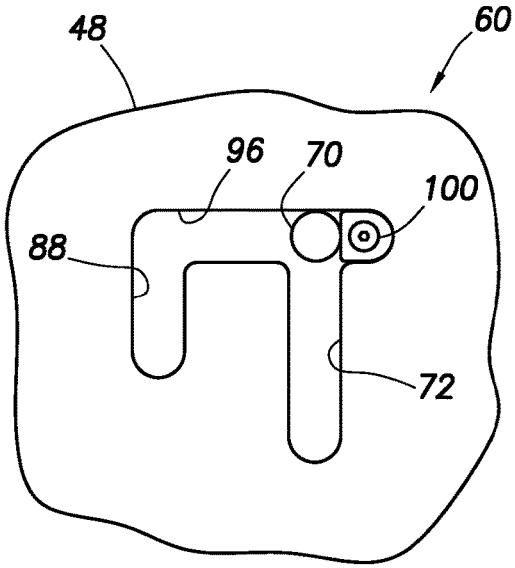

Once the rotating control device 40 is properly engaged as described above, the inner mandrel 48 can then be rotated as in the FIGS. 4A&B configuration. As shown in FIG. 13B, the inner mandrel 48 would have to set down weight and rotate circumferentially simultaneously. In response to this rotation, the pin 70 will displace circumferentially in the slot 96, as depicted in FIGS. 12C, 13C & 14C, so that the pin is now aligned with the longitudinal slot 72. Then, upward displacement of the inner mandrel 48 will result in the pin 70 displacing in the longitudinal slot 72, thereby allowing the release members 74 to retract. The running tool 50 will then disengage the rotating control device 40.

Referring additionally now to FIGS. 15A-18B, another example of the running tool 50 is representatively illustrated. In this example, the running tool 50 can both convey the rotating control device 40 into the riser housing 26, and retrieve the rotating control device from the housing.

The FIGS. 15A-18B running tool 50 actuates in response to a downward force (e.g., "set down" weight) applied to the running tool. In this example, the rotating control device 40 engages a shoulder or "no-go" when it is conveyed into the riser housing 26 by the running tool 50, at which point a latch mechanism (not shown) in the housing is actuated to engage an external profile 102 (see FIG. 18B) on the rotating control device to thereby secure the rotating control device to the housing. The downward force is then applied to the running tool 50 to cause the release mechanism to actuate and release the running tool from the rotating control device 40.

Retrieval of the rotating control device 40 from the riser housing 26 is essentially an opposite order of the steps described above for installing the rotating control device in the housing. The running tool 50 is conveyed into the rotating control device 40, and a downward force is applied to the running tool to cause the release members 74 of the release mechanism 60 to extend outwardly into engagement with an internal profile 104 in the rotating control device (see FIG. 18A). The latch mechanism in the riser housing 26 is then actuated to release the rotating control device 40 from the housing. The running tool 50 can then be used to pull the rotating control device 40 out of the riser housing 26 and retrieve the rotating control device to surface.

In the FIGS. 15A-18B example, the release members 74 are in the form of longitudinally extending resilient collets. When the release members 74 are radially inwardly supported by the inner mandrel 48, they can securely engage the internal profile 104 in the rotating control device 40. When the inner mandrel 48 is displaced longitudinally relative to the release members 74, so that the release members are adjacent the radially reduced portion 48*a* of the inner mandrel, the release members can flex inward and disengage from the inner profile 104 (during installation), or flex inward and engage the inner profile (during retrieval).

The release mechanism 60 in this example comprises an indexing mechanism that positions the inner mandrel 48 for supporting or un-supporting the release members 74 that snap into the internal profile 104 in the rotating control device 40. The indexing mechanism is provided with two or more positions that alternately support or un-support the release members 74.

The indexing mechanism is similar in many respects to a well-known ball point pen retracting mechanism. Internal of the sleeve 86 is a set of angular bias keys 106 (see FIG. 17) that stab into a set of saw-tooth teeth 108 on an indexing sleeve 110. The indexing sleeve 110 is rotated freely about the inner mandrel 48 as it rotates and indexes relative to the angular bias keys 106.

The inner mandrel 48 also has a set of ratcheting teeth 112 that are continually biased into contact with the saw-tooth teeth 108 on the indexing sleeve 110 by a spring 114. Another spring 116 is positioned in an upper part of the inner mandrel 48 to continually bias the inner mandrel downward, so that it supports the release members 74. The spring 116 exerts a substantially greater biasing force as compared to the spring 114.

Figure 18A:
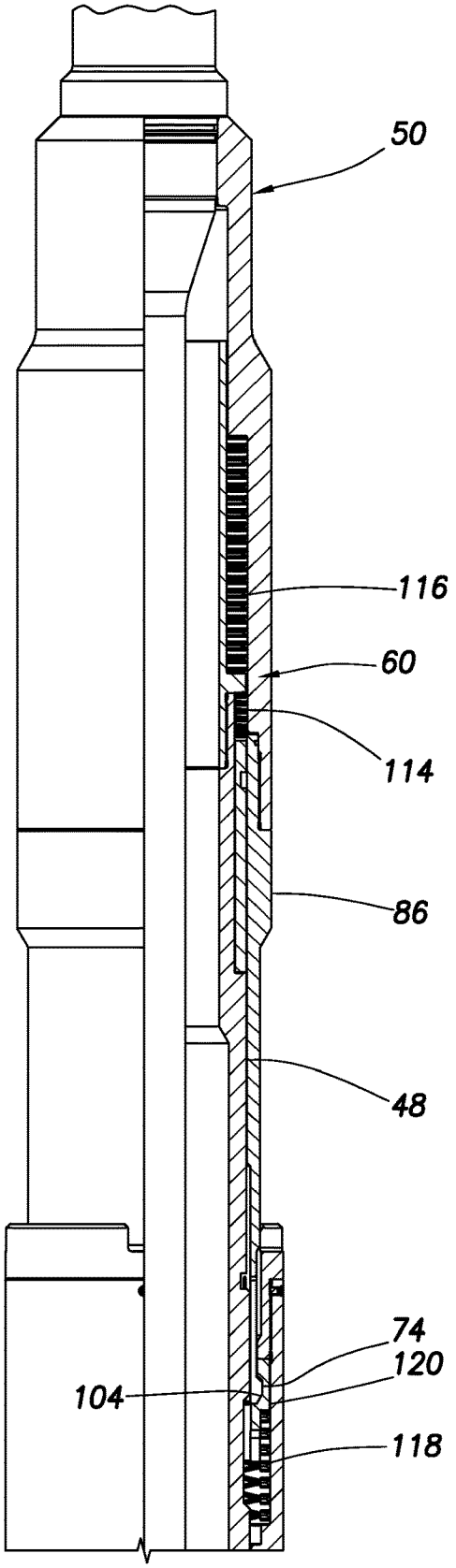
FIGS. 18A&B are representative partially cross-sectional views of the running tool engaged with another example of the rotating control device.
Figure 18B:
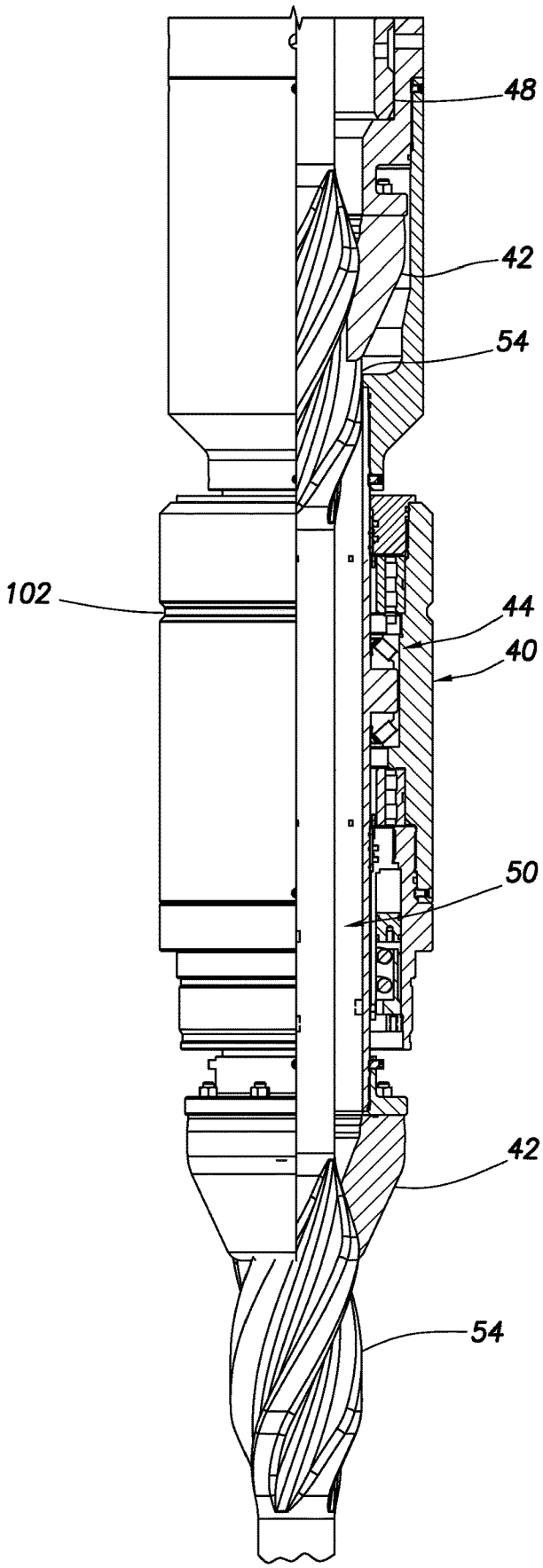

To set or unset the running tool 50, with the rotating control device 40 shouldered against the riser housing 26, a weight or force is applied to overcome the biasing force exerted by the spring 116 and thereby displace the inner mandrel 48 lower end inward (the inner mandrel is shouldered against the rotating control device, see FIG. 18B). As the inner mandrel 48 displaces inward, the angular bias keys 106 release from the saw-tooth teeth 108 and allow the indexing sleeve 110 to jump into a next circumferential position. The relative circumferential positions of the saw-tooth teeth 108 and the indexing sleeve 110 determine the longitudinal position of the inner mandrel 48 relative to the release members 74.

When the weight or force on the running tool 50 is removed, the ratcheting teeth 112 will lock the inner mandrel 48 in either a supporting or non-supporting longitudinal position relative to the release members 74. When the inner mandrel 48 is in the non-supporting position, the release members 74 are free to deflect inward and snap into (or out of) the internal profile 104.

The internal profile 104 is positioned above the bearing assembly 44. A spring 118 (see FIG. 18A) is positioned below a sleeve 120 in which the internal profile 104 is formed, to compensate for displacement of the inner mandrel 48 relative to the rotating control device 40.

It may now be fully appreciated that the above disclosure provides significant advancements to the art of constructing and operating rotating control devices and running and retrieval tools therefor. The above examples provide for convenient and reliable installation, operation and retrieval of rotating control devices.

In one respect, the above disclosure provides to the art a rotating control device 40. In one example, the rotating control device 40 can comprise a latch assembly 46 including: at least one outwardly extendable latch member 56; an inner mandrel 62 displaceable in a longitudinal direction relative to the latch member 56 to outwardly extend the latch member 56; and a lock ring 64 that permits displacement of the inner mandrel 62 in the longitudinal direction, and prevents displacement of the inner mandrel 62 in an opposite longitudinal direction.

The lock ring 64 may comprise a gripping surface 66. The gripping surface 66 can include teeth formed on the lock ring 64. The lock ring 64 may be generally C-shaped and/or radially expandable.

The lock ring gripping surface 66 may engage a gripping surface 68 formed on the inner mandrel 62. The lock ring gripping surface 66 may be initially spaced apart from the inner mandrel gripping surface 68. The lock ring gripping surface 66 may engage the inner mandrel gripping surface 68 only in response to the displacement of the inner mandrel 62 in the longitudinal direction.

The rotating control device 40 may include an equalization valve 90 having an open configuration in which fluid communication is permitted between an exterior and an interior of the rotating control device 40 through the equalization valve 90. The latch assembly 46 changes from a latched configuration to an unlatched configuration only when the equalization valve 90 is in the open configuration.

The rotating control device 40 may include a bearing assembly 44 secured to the latch assembly 46. The rotating control device 40 may also include at least one inwardly extending annular seal 42 rotatably supported by the bearing assembly 44.

The above disclosure also provides to the art another rotating control device 40. In one example, the rotating control device 40 can comprise a latch assembly 46 having a latched configuration and an unlatched configuration, and an equalization valve 90 having an open configuration in which fluid communication is permitted between an exterior and an interior of the rotating control device 40 through the equalization valve 90. The latch assembly 46 changes from the latched configuration to the unlatched configuration only when the equalization valve 90 is in the open configuration.

The latch assembly 46 may include an inner mandrel 62 and a latch member 56, the inner mandrel 62 being displaceable in a longitudinal direction to outwardly extend the latch member 56. The equalization valve 90 changes from the open configuration to a closed configuration in response to displacement of the inner mandrel 62 in the longitudinal direction.

The equalization valve 90 may include a closing piston 92. The inner mandrel 62 can displace the closing piston 92 from the open configuration to the closed configuration.

The inner mandrel 62 may displace the closing piston 92 to a closed position against a biasing force exerted by a biasing device 94 of the equalization valve 90. The biasing device 94 can displace the closing piston 92 to an open position when the equalization valve 90 changes from the closed configuration to the open configuration.

The inner mandrel 62 may be displaceable in a second longitudinal direction, opposite to the first longitudinal direction, to inwardly retract the latch member 56. The equalization valve 90 can change from the closed configuration to the open configuration in response to displacement of the inner mandrel 62 in the second longitudinal direction.

The rotating control device 40 may include at least one inwardly extending annular seal 42 secured to the latch assembly 46. The equalization valve 90 can be positioned between the latch assembly 46 and the annular seal 42.

The rotating control device 40 can include a bearing assembly 44 which rotatably supports the annular seal 42. The equalization valve 90 can be positioned between the latch assembly 46 and the bearing assembly 44.

The latch assembly 46 may include an inner mandrel 62, a latch member 56, and a lock ring 64, the inner mandrel 62 being displaceable in a longitudinal direction to outwardly extend the latch member 56. The lock ring 64 can permit displacement of the inner mandrel 62 in the longitudinal direction, and prevent displacement of the inner mandrel 62 in an opposite longitudinal direction.

A method of installing a rotating control device 40 in a riser housing 26 is also described above. In one example, the method can comprise: securing a running tool 50 to the rotating control device 40; conveying the rotating control device 40 into the riser housing 26 while the running tool 50 is secured to the rotating control device 40; and releasing the running tool 50 from the rotating control device 40 by producing relative rotation between components of the running tool 50 and the latch assembly 46.

A first component may comprise an inner mandrel 48 that outwardly supports a release member 74 in engagement with the rotating control device 40 when the running tool 50 is secured to the rotating control device 40.

A second component may comprise a sleeve 86 positioned on the inner mandrel 48, the sleeve 86 longitudinally retaining the release member 74 relative to the inner mandrel 48 prior to the releasing step.

The relative rotation may permit the sleeve 86 to displace longitudinally relative to the inner mandrel 48, thereby allowing the release member 74 to inwardly retract out of engagement with the rotating control device 40.

The release member 74 may inwardly retract in response to longitudinal displacement of the inner mandrel 48 relative to the release member 74.

The step of producing relative rotation may include shearing a shear member 100 anchored in position to the inner mandrel 48 of the running tool 50. The shearing step may include permitting relative circumferential displacement between a retainer collet 98 and a circumferentially extending slot 96.

The retainer collet 98 may secure a pin 70 relative to the circumferentially extending slot 96 prior to the shearing step. The step of permitting relative circumferential displacement may include aligning the pin 70 with a longitudinally extending slot 72.

The releasing step may include producing relative longitudinal displacement between the pin 70 and the longitudinally extending slot 72.

The step of producing relative rotation may include displacing a pin 70 relative to a J-slot (e.g., the combined slots 72, 88, 96 of FIGS. 12A-14D).

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of installing a rotating control device in a riser housing, the method comprising:

securing a running tool to the rotating control device;

conveying the rotating control device into the riser housing while the running tool is secured to the rotating control device; and releasing the running tool from the rotating control device by producing relative rotation between first and second components of the running tool.

2. The method of claim 1, wherein the first component comprises an inner mandrel that outwardly supports a release member in engagement with the rotating control device when the running tool is secured to the rotating control device.

3. The method of claim 2, wherein the second component comprises a sleeve positioned on the inner mandrel, the sleeve longitudinally retaining the release member relative to the inner mandrel prior to the releasing.

4. The method of claim 1, wherein the producing relative rotation comprises shearing a shear member.

5. The method of claim 4, wherein the shearing comprises permitting relative circumferential displacement between a retainer collet and a circumferentially extending slot.

6. The method of claim 5, wherein the retainer collet secures a pin relative to the circumferentially extending slot prior to the shearing.

7. The method of claim 1, wherein the producing relative rotation comprises displacing a pin relative to a J-slot.

* * * * *